US010274880B2

(12) United States Patent
Shigehiro et al.

(10) Patent No.: US 10,274,880 B2
(45) Date of Patent: Apr. 30, 2019

(54) IMAGE FORMING APPARATUS

(71) Applicant: CANON KABUSHIKI KAISHA, Tokyo (JP)

(72) Inventors: Koji Shigehiro, Toride (JP); Ryohei Terada, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/729,950

(22) Filed: Oct. 11, 2017

(65) Prior Publication Data

US 2018/0107143 A1 Apr. 19, 2018

(30) Foreign Application Priority Data

Oct. 19, 2016 (JP) ..... 2016-205363

(51) Int. Cl.

| | |
|---|---|
| ***G03G 15/08*** | (2006.01) |
| ***G03G 15/00*** | (2006.01) |
| ***G03G 21/20*** | (2006.01) |

(52) U.S. Cl.

CPC ..... *G03G 15/50* (2013.01); *G03G 15/0865* (2013.01); *G03G 21/203* (2013.01)

(58) Field of Classification Search

CPC ..... G03G 15/50
USPC ..... 399/53
See application file for complete search history.

(56) References Cited

U.S. PATENT DOCUMENTS

| | | | |
|---|---|---|---|
| 9,176,430 | B2 | 11/2015 | Yoshizawa et al. |
| 9,244,376 | B2 | 1/2016 | Kuramoto et al. |
| 2011/0311263 | A1 | 12/2011 | Mizuta |

FOREIGN PATENT DOCUMENTS

| | | | | |
|---|---|---|---|---|
| JP | 06035312 | A | * | 2/1994 |
| JP | H06-075466 | A | | 3/1994 |
| JP | H09-034255 | A | | 2/1997 |
| JP | 2005-062659 | A | | 3/2005 |
| JP | 2005-070583 | A | | 3/2005 |
| JP | 2009-116249 | A | | 5/2009 |

(Continued)

OTHER PUBLICATIONS

Computer translation of JP06-075466A to Nagayama et al., published Mar. 1994.*

(Continued)

*Primary Examiner* — Quana Grainger
(74) *Attorney, Agent, or Firm* — Venable LLP

(57) ABSTRACT

An image forming apparatus includes a controller to control a driving unit that rotates a developing rotary member. Rotation speed of the developing rotary member is controlled to become a first rotation speed in an image forming period. Rotation speed of the developing rotary member is decelerated from the first rotation speed in a first period of a non-image forming period so that the rotation speed becomes a second rotation speed lower than the first rotation speed, and rotation speed is decelerated from the second rotation speed in a second period subsequent to the first period of the non-image forming period so that the rotation of the developing rotary member is stopped. A deceleration amount per unit time of the developing rotary member in the first period is smaller than a deceleration amount per unit time of the developing rotary member in the second period.

20 Claims, 11 Drawing Sheets

(56) References Cited

FOREIGN PATENT DOCUMENTS

| | | | |
|---|---|---|---|
| JP | 2014-178347 | A | 9/2014 |
| JP | 2015-072331 | A | 4/2015 |

OTHER PUBLICATIONS

European Written Opinion and Search Report dated Dec. 26, 2017, in PCT Application No. PCT/JP2017/038596).

* cited by examiner

IMAGE FORMING APPARATUS

BACKGROUND OF THE INVENTION

Field of the Invention

The present invention relates to an image forming apparatus, for example, a copying machine, a printer, or a facsimile machine, which uses an electrophotographic system or an electrostatic recording system.

Description of the Related Art

Hitherto, in an image forming apparatus using an electrophotographic system, an electrostatic latent image formed on an image bearing member such as a photosensitive member is developed with use of developer by a developing device. In general, the developing device includes a developer container and a developer bearing member. The developer container is configured to store developer. The developer bearing member is rotatably provided to the developer container so as to be at least partially exposed to an outside through an opening portion formed in the developer container. As the developer, there has been known two-component developer including non-magnetic toner particles (toner) and magnetic carrier particles (carrier). The two-component developer does not require a magnetic material to be included in toner, and hence good color quality can be obtained. For such reason, the two-component developer has widely been used.

In this developing device, in some cases, there is generated an airflow which flows from an inside to an outside of the developer container through a portion connecting the inside and the outside of the developer container, such as a gap between the developer container and the developer bearing member. Further, in some cases, toner separated from carrier flows on the airflow, is scattered from the inside to the outside of the developer container, and adheres to a charging device, a transfer device, or an exposing device, which are provided in a periphery of the developing device.

In view of such circumstances, there has been proposed a method of reducing an internal pressure of a developer container by providing a filter to the developer container (Japanese Patent Application Laid-Open No. 2014-178347). Further, there has been proposed a method of allowing an airflow in a developer container to escape by forming an inflow port and a discharge port for the airflow (Japanese Patent Application Laid-Open No. 2015-72331).

However, in some cases, there is difficulty in suppressing scattering of toner even with use of the related-art configurations. Such scattering of toner is scattering of toner from the developing device at the time of stopping drive of the developer bearing member.

That is, during the drive of the developer bearing member, the pressure inside the developer container tends to be increased by the airflow flowing into the developer container. At the time of stopping the drive of the bearing member, when the inflow of air to the inside of the developer container is stopped before the pressure inside the developer container is statically set, the air including toner is liable to be blown out to the outside of the developing device due to the pressure inside the developer container. As a measure for such a problem, there has been given a slow-down control of reducing a rotational speed and stopping the developer bearing member at the time of stopping the drive of the developer bearing member (Japanese Patent Application Laid-Open No. H06-75466 and Japanese Patent Application Laid-Open No. H09-34255). However, with such a configuration, time required for stopping the drive of the developer bearing member becomes longer.

SUMMARY OF THE INVENTION

The present invention has an object to provide an image forming apparatus capable of suppressing scattering of toner from a developing device, which occurs due to an operation of stopping drive of a developer bearing member, without increasing time for a drive stopping operation for the developer bearing member.

The present invention has another object to provide an image forming apparatus, including: a developer containing unit configured to contain developer; a developer bearing member, which is rotatably provided in the developer containing unit, and is configured to bear the developer; a driving unit configured to drive the developer bearing member; and a control unit configured to control the driving unit so that, when rotation of the developer bearing member is stopped after an image forming operation is terminated, drive transmission to the developer bearing member is turned off after a rotational speed of the developer bearing member is reduced to a set rotational speed lower than a rotational speed of the developer bearing member during the image formation while performing the drive transmission to the developer bearing member.

Further features of the present invention will become apparent from the following description of exemplary embodiments with reference to the attached drawings.

DESCRIPTION OF THE EMBODIMENTS

Now, an image forming apparatus according to the present invention is described in detail with reference to the attached drawings.

First Embodiment

1. Overall Configuration and Operation of Image Forming Apparatus

Figure 1:
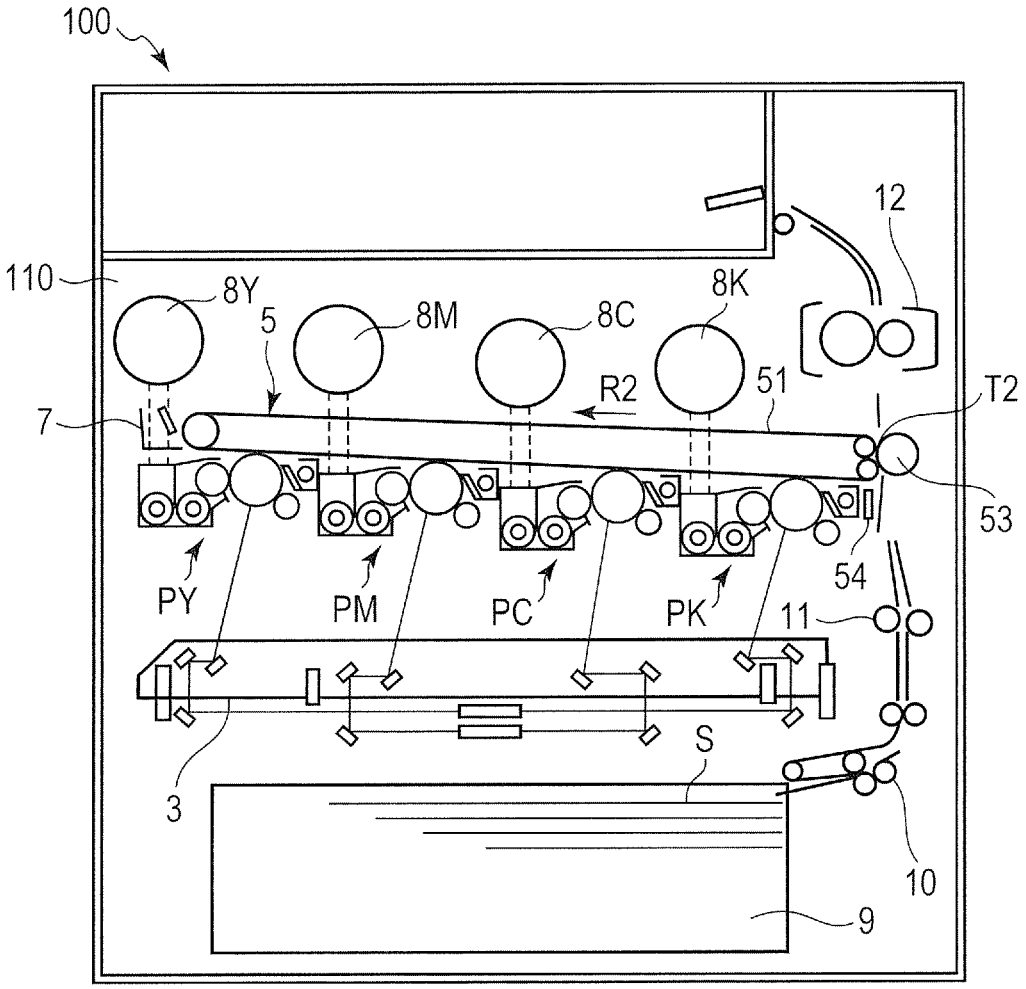
FIG. 1 is a schematic sectional view of an image forming apparatus.

FIG. 1 is a schematic sectional view of an image forming apparatus 100 according to a first embodiment of the present invention. The image forming apparatus 100 according to the first embodiment is a tandem-type laser beam printer employing an intermediate transfer system, which is capable of forming a full-color image using an electrophotographic system.

Figure 2:
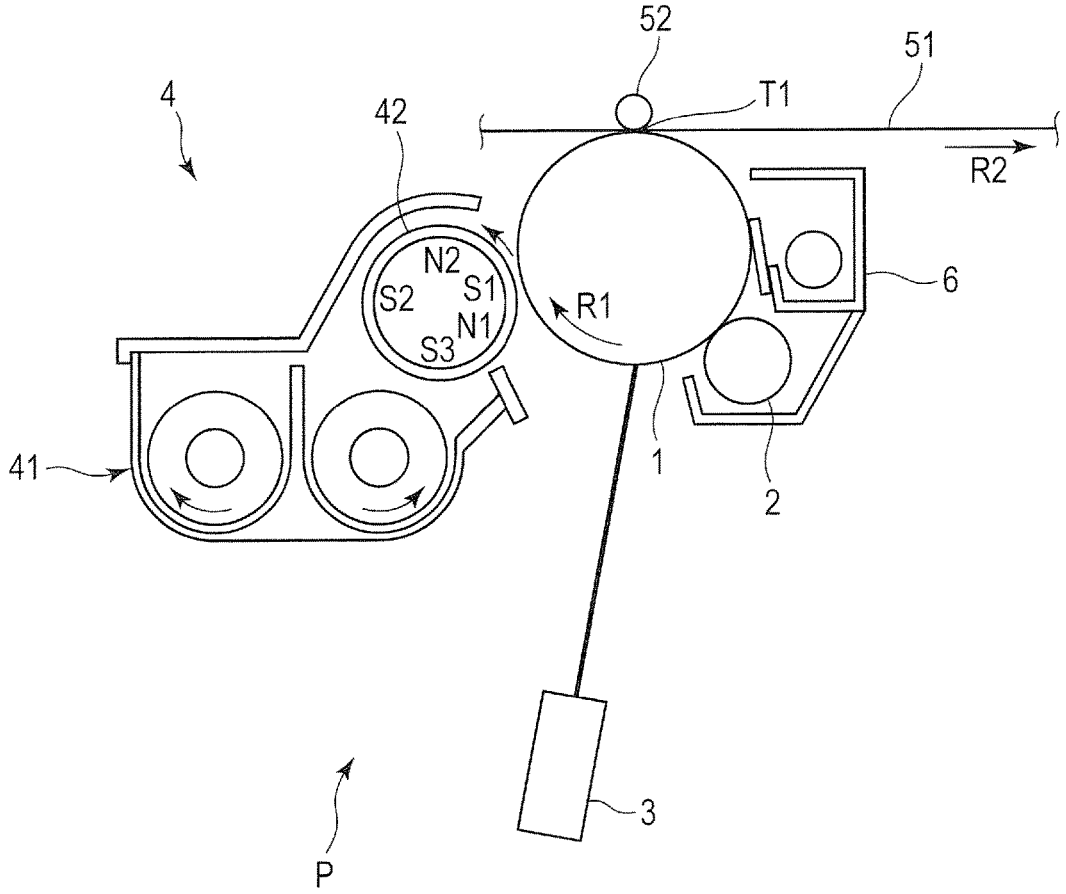
FIG. 2 is a schematic sectional view of an image forming portion.

The image forming apparatus 100 includes a first image forming portion PY, a second image forming portion PM, a third image forming portion PC, and a fourth image forming portion PK, which are configured to form images of yellow (Y), magenta (M), cyan (C), and black (K), respectively. Components which are provided to the image forming portions PY, PM, PC, and PK and have the same or corresponding functions or configurations are collectively described in some parts without the suffixes Y, M, C, and K of the reference symbols indicating colors associated with the components. FIG. 2 is a schematic sectional view for illustrating the image forming portion P. In the first embodiment, the image forming portion P includes a photosensitive drum 1, a charging roller 2, an exposing device 3, a developing device 4, a primary transfer roller 52, and a drum cleaning device 6.

The photosensitive drum 1 is a photosensitive member (electrophotographic photosensitive member) of a rotatable drum-type and serves as an image bearing member configured to bear a toner image. The photosensitive drum 1 is driven to rotate in a direction indicated by the arrow R1 in FIG. 2 (clockwise direction). A surface of the photosensitive drum 1 being rotated is uniformly charged to a predetermined potential with a predetermined polarity (negative polarity in the first embodiment) by the charging roller 2 being a charging unit. At the time of charging, a predetermined charging voltage (charging bias) is applied to the charging roller 2 from a charging power source (not shown). The charged surface of the photosensitive drum 1 is scanned and exposed with light by the exposing device (laser scanner) 3 being an exposing unit in accordance with image information so that an electrostatic latent image (latent image) is formed on the photosensitive drum 1. In the first embodiment, the exposing device 3 is a single unit capable of exposing the photosensitive drums 1 of the image forming portions P with light. The electrostatic latent image formed on the photosensitive drum 1 is developed (visualized) by the developing device 4 being a development unit, thereby forming a toner image on the photosensitive drum 1. In the first embodiment, the toner charged to the same polarity (negative polarity in the first embodiment) as the charging polarity of the photosensitive drum 1 adheres to an exposed portion on the photosensitive drum 1, which has a reduced absolute value of the potential through the exposure with light after the uniform charging process (reversal phenomenon). The developing device 4 is described later in more detail.

The transfer device 5 is arranged above the photosensitive drums 1 in FIG. 1. The transfer device 5 includes an intermediate transfer belt 51. The intermediate transfer belt 51 is arranged so as to be opposed to the photosensitive drums 1 of the image forming portions P, and is constructed by an endless belt being an intermediate transfer member. The intermediate transfer belt 51 is placed around a plurality of tension rollers and is stretched with a predetermined tension. The intermediate transfer belt 51 is rotated or revolves in a direction indicated by the arrow R2 illustrated in FIG. 1 when a drive roller being one of the plurality of tension rollers is driven to rotate. At positions opposed to the photosensitive drums 1 on an inner peripheral surface side of the intermediate transfer belt 51, there are arranged primary transfer rollers 52 being primary transfer units. The primary transfer rollers 52 are pressed against the photosensitive drum 1 through intermediation of the intermediate transfer belt 51, thereby forming primary transfer portions T1 at which the photosensitive drums 1 and the intermediate transfer belt 51 are held in contact with each other. Further, at a position opposed to a secondary transfer opposing roller being one of the plurality of tension rollers on an outer peripheral surface side of the intermediate transfer belt 51, there is arranged a secondary transfer roller 53 being a secondary transfer unit. The secondary transfer roller 53 is pressed against the secondary transfer opposing roller through intermediation of the intermediate transfer belt 51, thereby forming a secondary transfer portion T2 at which the intermediate transfer belt 51 and the secondary transfer roller 53 are held in contact with each other.

The toner image formed on the photosensitive drum 1 is transferred (primarily transferred) at a primary transfer portion T1 to the intermediate transfer belt 51 being rotated. At the time of the primary transfer, a primary transfer voltage (primary transfer bias) being a direct-current voltage having a reverse polarity (positive polarity in the first embodiment) to the charging polarity (original charging polarity) of the toner at the time of development is applied from a primary transfer power source (not shown) to the primary transfer rollers 52. For example, at the time of formation of a full-color image, the toner images of yellow, magenta, cyan, and black formed respectively on the photosensitive drums 1 are sequentially transferred to the intermediate transfer belt 51 so as to be superimposed with each other. The toner images formed on the intermediate transfer belt 51 are transferred (secondarily transferred) at the secondary transfer portion T2 to a recording material (recording medium, transfer material, or sheet) S such as a paper sheet which is sandwiched and conveyed by the intermediate transfer belt 51 and the secondary transfer roller 53. At the time of the secondary transfer, a secondary transfer voltage being a direct-current voltage having a reverse polarity (positive polarity in the first embodiment) to the original charging polarity of toner is applied from a secondary transfer power source (not shown) to the secondary transfer roller 53. The recording material S is accommodated in a cassette 9 being a recording member accommodating portion. The recording material S accommodated in the cassette 9 is conveyed to registration rollers 11 by a feed-conveyance portion 10 including a pickup roller and a conveyance roller. The recording material S is fed to a secondary transfer portion T2 by the registration rollers 11 in synchronization with the toner images on the intermediate transfer belt 51.

The recording material S having the toner images transferred thereto is conveyed to a fixing device 12 being a fixing unit. The recording material S is heated and pressurized by the fixing device 12 so that the toner images are fixed (melted and caused to firmly adhere). Thereafter, the recording material S is delivered to an outside of an apparatus main body 110 of the image forming apparatus 100.

The toner which remains on the surface of the photosensitive drum 1 after the primary transfer (primary transfer residual toner) is removed and collected from the surface of the photosensitive drum 1 by the drum cleaning device 6 being a photosensitive member cleaning unit. The toner which remains on the surface of the intermediate transfer belt 51 after the secondary transfer (secondary transfer residual toner) is removed and collected from the surface of the intermediate transfer belt 51 by the belt cleaning device 7 being an intermediate transfer member cleaning unit.

2. Developing Device

Figure 3:
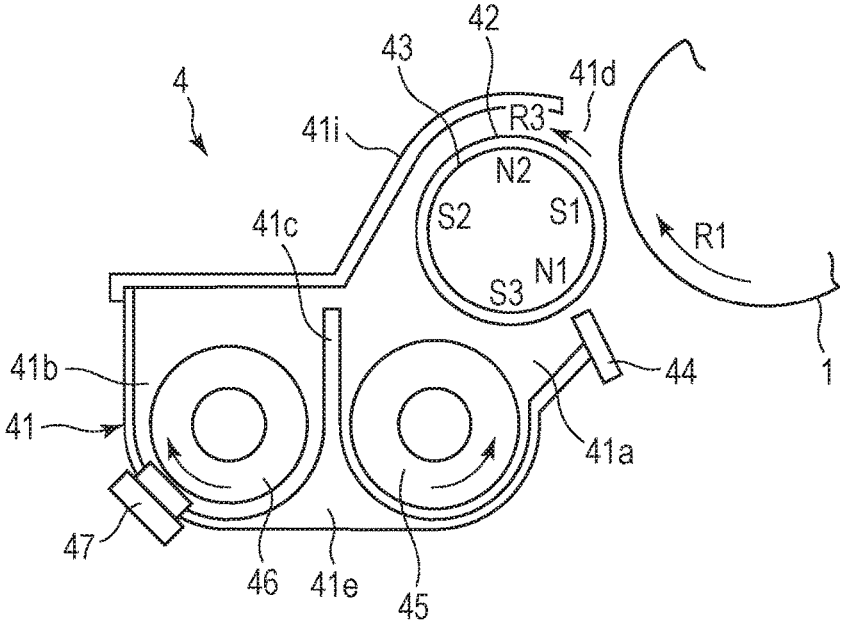
FIG. 3 is a schematic sectional view of a developing device.
Figure 4:
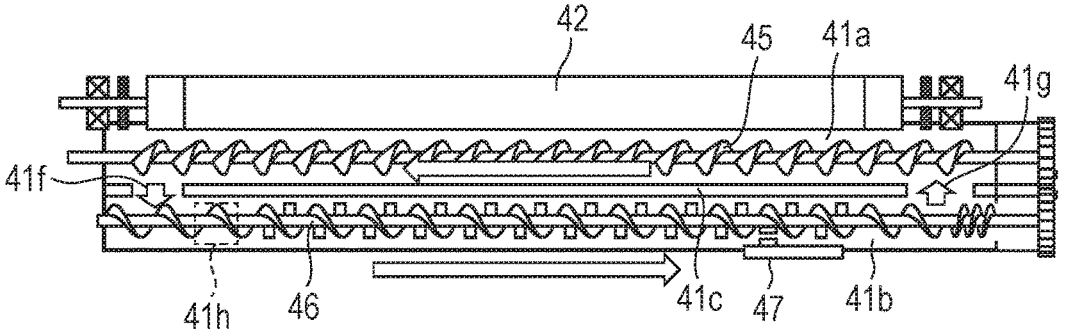
FIG. 4 is a schematic top view of the developing device.

Next, further description is made of the developing device 4 of the first embodiment. FIG. 3 is a schematic sectional view of the developing device 4 as seen in a rotary axis direction of the photosensitive drum 1. Further, FIG. 4 is a schematic top view of the developing device 4 under a state in which an upper lid 41*i* is opened.

In the developing device 4 of the first embodiment, there is used two-component developer as the developer. The two-component developer includes non-magnetic toner particles (toner) and magnetic carrier particles (carrier). The developing device 4 includes a developer container 41 (developer containing unit) configured to contain the developer. The developer container 41 has an opening portion 41*d* at an opposed portion to the photosensitive drum 1. A hollow cylindrical developing sleeve 42 being a developer bearing member is rotatably provided to the developer container 41 in such a manner that the developing sleeve 42 is partially exposed to the outside through the opening portion 41*d*. The developing sleeve 42 is made of a non-magnetic material. The developing sleeve 42 is driven by a driving unit 120 (FIG. 5) being a driving unit to rotate in a direction indicated by the arrow R3 in FIG. 3 (counterclockwise direction). That is, the developing sleeve 42 is driven to rotate in a direction in which the photosensitive drum 1 and the developing sleeve 42 are moved in a forward direction at an opposed portion (developing region) between the photosensitive drum 1 and the developing sleeve 42. The driving unit 120 includes a DC motor being a drive source and a drive transmission member such as a gear. In the developing sleeve 42 (hollow portion), there is arranged a magnet roll (magnet) 43 being a magnetic field generating unit. The magnet roll 43 is arranged so as to be fixed in the developer container 41 so that the magnet roll 43 is prevented from being rotated. The magnet roll 43 has a plurality of magnetic poles along a circumferential direction. At one edge portion of the opening portion 41*d* of the developer container 41, that is, at an edge portion on an upstream side in the rotation direction of the developing sleeve 42, there is provided a developing blade 44 being a regulation member, which is configured to regulate an amount (layer thickness) of developer borne on the surface of the developing sleeve 42.

The inside of the developer container 41 is partitioned into a developing chamber 41*a* and an agitating chamber 41*b* by a partition wall 41 extending in a substantially vertical direction. At both end portions of the partition wall 41*c* in a longitudinal direction, that is, on the left side and the right side in FIG. 4, there are formed delivering portions 41*f* and 41*g* for allowing passage of developer between the developing chamber 41*a* and the agitating chamber 41*b*. The developing chamber 41*a*, the agitating chamber 41*b*, and the delivering portions 41*f* and 41*g* construct a conveyance passage for the developer. A top portion of a container main body 41*e* forming the developing chamber 41*a* and the agitating chamber 41*b* is closed by the upper lid 41*i*. The opening portion 41*d* opposed to the photosensitive drum 1 is formed by the container main body 41*e* and the upper lid 41*i*.

In the developing chamber 41*a*, there is arranged a first screw 45 being a conveyance member. In the agitating chamber 41*b*, there is arranged a second screw 46 being a conveyance member. The first screw 45 and the second screw 46 are screw members each having a spiral fin being a conveyance portion around a shaft (rotary shaft) of a magnetic material. In the first embodiment, the first screw 45 and the second screw 46 receive a driving force distributed from the driving unit 120 configured to drive the developing sleeve 42, and are driven in conjunction with the developing sleeve 42. The first screw 45 is configured to agitate and convey the developer in the developing chamber 41*a*. The second screw 46 is configured to agitate and convey toner, which is supplied into the agitating chamber 41*b* through a replenishment port 41*h*, and developer in the agitating chamber 41*b*, thereby obtaining uniform toner density of the developer. The first screw 45 and the second screw 46 are rotated about rotary axes which are substantially parallel to the rotary axis direction (developing width direction) of the developing sleeve 42. The first screw 45 and the second screw 46 convey the developer in directions opposite to each other along the rotary axis direction of the developing sleeve 42. With this configuration, the developer is circulated in the developer container 41 through the delivering portions 41*f* and 41*g*.

The developer in the developing chamber 41*a*, which is reduced in toner density through consumption of toner in the developing step, moves to the agitating chamber 41*b* through one delivering portion 41*f* (on the left side in FIG. 4). A toner hopper 8 (FIG. 1) being a replenishment device is coupled to the replenishment port 41*h* formed in the vicinity of the most upstream portion of the agitating chamber 41*b*. At a toner discharge port (not shown) of the toner hopper 8, there is provided a replenishment screw (not shown) configured to convey the toner. The toner of the amount corresponding to the consumption by developing operation is replenished from the toner hopper 8 to the agitating chamber 41*b* through the replenishment port 41*h*. The developer which is agitated and mixed with the replenished toner in the agitating chamber 41*b* moves to the developing chamber 41*a* through another delivering portion 41*g* (on the right side in FIG. 4). The developer having moved to the developing chamber 41*a* is supplied to the developing sleeve 42.

In the developer container 41, as a density detecting unit configured to detect a toner density T/D of the developer, that is, a ratio of a weight of toner to a weight of developer, there is provided an inductance sensor 47 configured to detect a magnetic permeability of the developer in the agitating chamber 41*b*. The inductance sensor 47 generally detects the toner density T/D in the following manner. An induced current is generated in a coil in accordance with the amount of the magnetic material included in the space within a detection region. The amount of a current is changed in accordance with a ratio of toner, carrier, and a gap within the detection region. The toner density T/D can be detected based on a potential difference between a potential resulting from the current and a reference voltage applied to another coil. A control of the toner replenishment operation (toner replenishment control) for the developing device 4 is described in a second embodiment of the present invention, which is highly relevant. The toner replenishment control employed in the first embodiment is the same as that to be described in the second embodiment.

In the developer, a friction generated in a course of being agitated and conveyed causes the toner to be charged into a negative polarity and causes the carrier to be charged into a positive polarity. With this action, in the developer having moved to the developing chamber 41*a*, the toner adheres to the surface of the carrier. This developer is attracted to the surface of the developing sleeve 42 by a magnetic field generated by a scooping magnetic pole S3 of the magnet roll 43, and is borne on the developing sleeve 42. With this action, a developer reservoir is formed in the vicinity of the scooping magnetic pole S3 on the developing sleeve 42. The developer on the developing sleeve 42 is conveyed by the rotation of the developing sleeve 42, and forms magnetic bristles caused to stand by the magnetic field generated by a cut magnetic pole N1 of the magnet roll 43. The magnetic bristles of developer are regulated by the developing blade 44, which is arranged opposed to the cut magnetic pole N1, so as to have a predetermined length. With this configuration, a predetermined amount of developer is conveyed to the developing region in which the photosensitive drum 1 and the developing sleeve 42 are opposed to each other. In the developing region, the developer on the developing sleeve 42 forms the magnetic bristles caused to stand by the magnetic field generated by a developing magnetic pole S1 of the magnet roll 43. In the first embodiment, the magnetic bristles on the developing sleeve 42 are brought into contact with the photosensitive drum 1 in the developing region. Then, toner is supplied from the magnetic bristles of the developer to the photosensitive drum 1, thereby developing the electrostatic image on the photosensitive drum 1 into a toner image. At this time, a developing voltage (developing bias), in which the direct-current voltage and the alternate-current voltage are superimposed, is applied from the developing power supply (not shown) to the developing sleeve 42. With this configuration, the developing efficiency, that is, an application rate of toner to the electrostatic latent image is improved.

After the toner is supplied to the photosensitive drum 1, the developer on the developing sleeve 42 is conveyed by the magnetic field, which is generated by the conveyance magnetic pole N2 of the magnet roll 43, and rotation of the developing sleeve 42. Then, the developer is stripped from the surface of the developing sleeve 42 by a repulsive magnetic field formed by a stripping magnetic pole S2 and the scooping magnetic pole S3 of the magnet roll 43, which have the same polarity, and returns to the developing chamber 41*a*.

3. Control Mode

Figure 5:
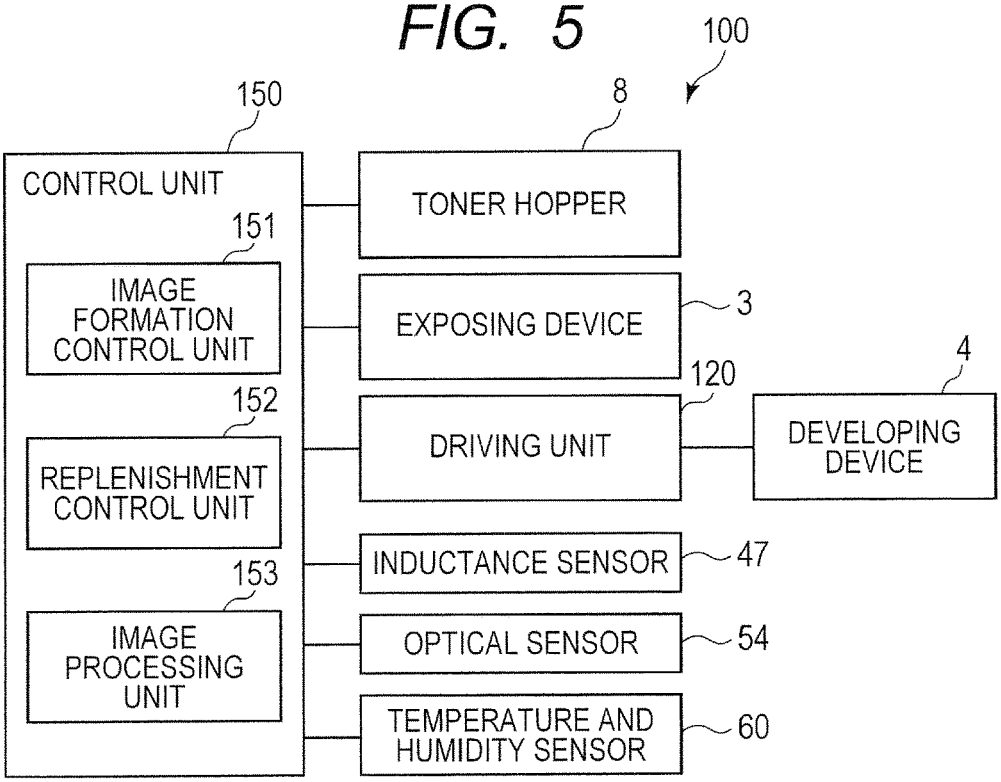
FIG. 5 is a block diagram for illustrating a control mode for main portions of the image forming apparatus.

FIG. 5 is a block diagram for illustrating a control mode for main components of the image forming apparatus 100. Operations of components of the image forming apparatus 100 are controlled by a control unit 150 provided in the apparatus main body 110. The control unit 150 includes a CPU, a ROM, and a RAM. The CPU serves as an arithmetic control unit. The ROM and the RAM serve as storing units. The control unit 150 performs a control for the image forming apparatus 100 using the RAM as a working region in accordance with a program stored in the ROM. In the first embodiment, an image reading device (reader) or a host device such as a personal computer (not shown), is communicably connected to the apparatus main body 110. The control unit 150 causes an image processing unit 153 to process image information from those devices and generate drive signals for the components, and causes an image formation control unit 151 to control operations of the components. Further, the control unit 150 causes a replenishment control unit 152 to perform a toner replenishment control for the developing device 4. An optical sensor 54 and a temperature and humidity sensor 60 illustrated in FIG. 5 are described in the second embodiment and subsequent embodiments.

4. Scattering of Toner

Figure 6:
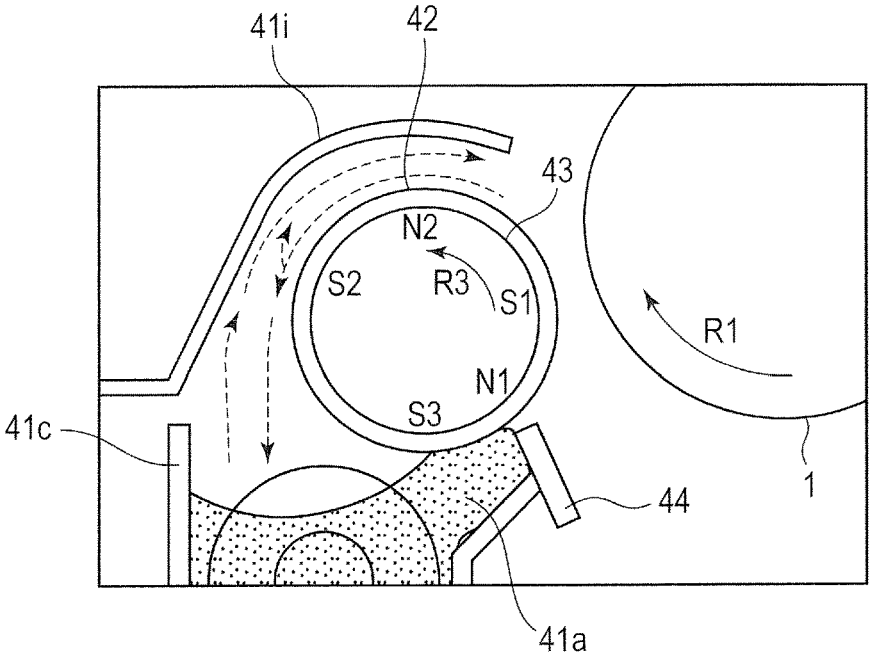
FIG. 6 is a schematic sectional view for illustrating an airflow inside a developer container.
Figure 7:
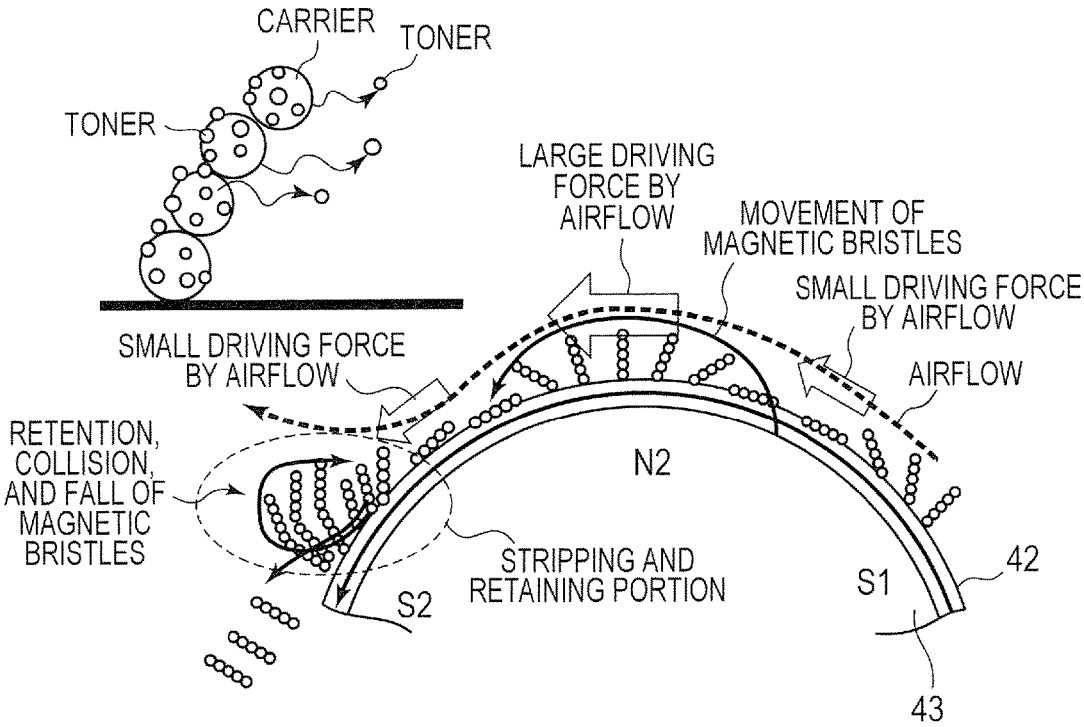
FIG. 7 is a schematic view for illustrating movement of developer and airflow around a developing sleeve.

Next, description is made of scattering of toner from the developing device 4. FIG. 6 is a schematic sectional view for illustrating an airflow in the developer container 41. Further, FIG. 7 is a schematic view for illustrating movement of developer and the airflow in a periphery of the developing sleeve 42.

When the magnetic bristles are caused to stand by the conveyance magnetic pole N2, toner may be separated from carrier by a centrifugal force. Further, when the magnetic bristles caused to stand by the stripping magnetic pole S2 collide against the developer reservoir formed by the scooping magnetic pole S3 immediately before the magnetic bristles are stripped from the developing sleeve 42, an impact caused by the collision may cause the toner to be separated from the carrier. Further, when the developer stripped from the developing sleeve 42 collides against the developer surface in the developing chamber 41*a*, an impact caused by the collision may cause the toner to be separated from the carrier. Further, before toner replenished to the developer container 41 is mixed with the developer in the developer container 41, the toner may fly in the air by an impact caused by the rotation of the second screw 46.

The rotation of the developing sleeve 42 and the movement of the developer borne on the developing sleeve 42 generate the airflow entering the developer container 41 from the outside into the inside. The inside of the developer container 41 is a space which is substantially closed except for the periphery of the developing sleeve 42. Therefore, the airflow having entered the developer container 41 causes a circulation flow in the developer container 41, thereby also generating an airflow flowing out from the developer container 41. As illustrated in FIG. 6, in the gap between the developing sleeve 42 and the upper lid 41*i*, the airflow flowing from the inside to the outside of the developer container 41 along the surface of the upper lid 41*i* is liable to be generated. Therefore, the toner separated from the carrier or the toner flying in the developer container 41 may flow on the airflow flowing out from the developer container 41, with the result that scattering of toner from the developing device 4 may occur.

In addition to the description above, there are following factors causing the scattering of toner. There is a case in which toner is scattered from developer immediately after having passed through an S-B gap being a gap between the developing blade 44 and the developing sleeve 42. Further, there is a case in which, in an S-D gap being a gap between the photosensitive drum 1 and the developing sleeve 42, when toner is separated from the carrier due to the action of the electric field, toner having been not collected due to the action of the electric field is scattered.

Among those, an amount of scattered toner having passed through the gap between the developing sleeve 42 and the upper lid 41*i* tends to be larger. That is, the toner having been scattered in the developer container 41 is liable to be scattered on the airflow flowing from the inside to the outside of the developer container 41 along the surface of the upper lid 41*i* in the gap between the developing sleeve 42 and the upper lid 41*i*. In contrast, in the S-B gap, the scattering of toner can be suppressed by attaching a seal member such as a urethane sheet to the developing blade 44. Further, in the S-D gap, the electric field acts dominantly, and hence the scattered toner amount becomes relatively smaller.

The scattering of toner caused by the various factors, in particular, the scattering of toner having passed through the gap between the developing sleeve 42 and the upper lid 41*i* occurs when a steady airflow is formed during the drive of the developing device 4, that is, during rotation of the developing sleeve 42 in a steady state. Such scattering of toner during the drive of the developing device 4 may be addressed, for example, by the configuration disclosed in Japanese Patent Application Laid-Open No. 2014-178347 or Japanese Patent Application Laid-Open No. 2015-72331.

However, there is difficulty in suppressing the scattering of toner from the developing device 4 at the time of stopping the drive of the developing device 4 (hereinafter also referred to as "during the stopping operation"). That is, during the drive of the developing device 4, there is formed an airflow, which flows in the developer container 41 from the outside, retained in the developer container 41, and flows out again from the developer container 41. When the airflow which flows in the developer container 41 from the outside is stopped during the stopping operation for the developing device 4, the state of the airflow during the drive of the developing device 4 is disturbed, and hence the air pressure inside the developer container 41 becomes larger than that during the drive of the developing device 4. Further, a path of the airflow which flows in the developer container 41 from the outside in the airflow during the drive of the developing device 4 entirely becomes a path of the airflow flowing out from the inside to the outside of the developer container 41 during the stopping operation for the developing device 4. Therefore, the air including the toner in the developer container 41 flows out at once to the outside of the developer container 41. With this action, there may occur irregular scattering of toner from the developing device 4 during the stopping operation for the developing device 4.

5. Suppression of Scattering of Toner

Next, description is made of suppression of scattering of toner from the developing device 4 during the stopping operation for the developing device 4 in the first embodiment.

The separation amount of toner from carrier in the steady state during the drive of the developing device 4 is significantly influenced by the centrifugal force in accordance with the rotational speed of the developing sleeve 42 except for the variation factors due to physical properties such as the charge amount of toner. Therefore, the separation amount is significantly changed by squares of an angular speed of the developing sleeve 42, that is, by the rotational speed of the developing sleeve 42. Further, part of kinetic energy lost by the collision of developer particles caused by the stripping magnetic pole S2 and kinetic energy lost at the time when the developer stripped from the developing sleeve 42 collides with the developer surface in the developing chamber 41*a* acts as a force of separating the toner from the carrier. The airflow generated by the rotation of the developing sleeve 42 also becomes stronger in proportion to the rotational speed of the developing sleeve 42. Therefore, as the rotational speed of the developing sleeve 42 is higher, the toner separated from the carrier is liable to flow on the airflow and flow out from the developer container 41. The rotational speed of the developing sleeve 42 is expressed in "peripheral speed."

As the peripheral speed of the developing sleeve 42 is higher, the separation amount of toner from the carrier in the developer container 41 is larger, and the airflow generated by the rotation of the developing sleeve 42 becomes stronger. Therefore, when the rotation of the developing sleeve 42 is rapidly stopped from such a state, toner is blown out at once from the gap between the developing sleeve 42 and the upper lid 41*i*, with the result that toner is liable to be scattered.

Figure 8:
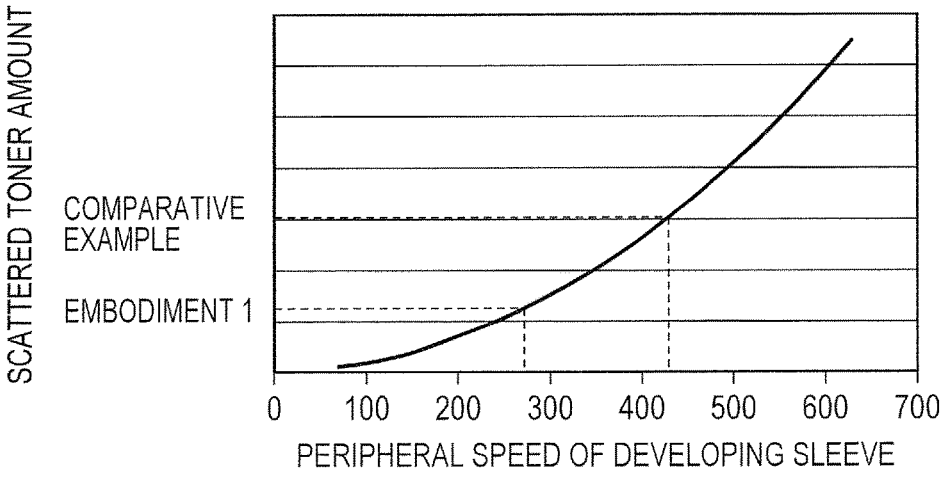
FIG. 8 is a graph for showing a relationship between a peripheral speed of the developing sleeve and a scattered toner amount.
Figure 9:
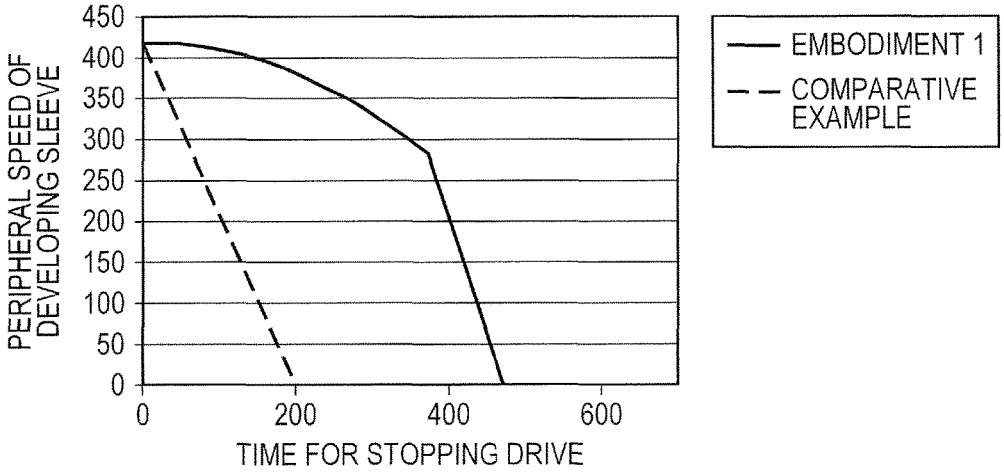
FIG. 9 is a graph for explaining a stopping operation for the developing device in a first embodiment of the present invention.

FIG. 8 is a graph for showing a relationship between the peripheral speed of the developing sleeve 42 and the scattered toner amount. Herein, a paper sheet is placed in the vicinity of the gap between the developing sleeve 42 and the upper lid 41*i*, and the developing device 4 is idled for a predetermined period of time. Then, the amount of toner adhering to the paper sheet is measured as an integration value of an adhesion area and a density, to thereby obtain the scattered toner amount. Further, FIG. 9 is a graph for showing a relationship between a time from a state in which the developing sleeve 42 is rotated in a steady state to the stopped state (herein also referred to as "time for stopping drive") and the peripheral speed of the developing sleeve 42.

In the first embodiment, in the steady state during the drive of the developing device 4, the peripheral speed of the developing sleeve 42 is 420 [mm/sec] (FIG. 8). When the state in which the developing sleeve 42 is driven to rotate at the peripheral speed of the steady state by the driving unit 120 is shifted to stop the drive by the driving unit 120 (DC motor is turned off), the rotation of the developing sleeve 42 is stopped within a time of about 200 msec (broken line in FIG. 9). When the rotation of the developing sleeve 42 is rapidly stopped, the scattering of toner occurs at the level of causing problems.

In the first embodiment, the control unit 150 performs the following control when the developing sleeve 42 is shifted from the state of being driven to rotate by the driving unit 120 to the state of being stopped without being driven by the driving unit 120 (during the stopping operation). That is, after the driving speed of the developing sleeve 42 by the driving unit 120 is reduced, the control unit 150 stops the drive of the developing sleeve 42 by the driving unit 120.

That is, during the stopping operation for the developing device 4, the driving speed of the developing sleeve 42 by the driving unit 120 is reduced at a sufficiently low deceleration rate (deceleration amount per unit time) until the peripheral speed of the developing sleeve 42 reaches the peripheral speed capable of sufficiently suppressing the blow of air including the toner from the developer container 41. Then, after the peripheral speed of the developing sleeve 42 reaches the peripheral speed capable of sufficiently suppressing the scattering of toner, the drive of the developing sleeve 42 by the driving unit 120 is stopped (DC motor is turned off). When the drive of the developing sleeve 42 is stopped, the peripheral speed of the developing sleeve 42 is reduced at a deceleration rate higher than a previous deceleration rate. However, the peripheral speed of the developing sleeve 42 is sufficiently reduced before the drive of the developing sleeve 42 is stopped, and hence the scattering of toner can sufficiently be suppressed. The irregular scattering of toner during the stopping operation for the developing device 4 is dependent on the peripheral speed of the developing sleeve 42. Therefore, during the stopping operation for the developing device 4, it is desired that the rotation of the developing sleeve 42 be stopped sufficiently slowly under the state in which the airflow is stabilized. However, extension of time for stopping drive more than necessary is not preferred in consideration of the stress on the developing sleeve 42 or developer. Therefore, in the first embodiment, during the stopping operation for the developing device 4, the peripheral speed of the developing sleeve 42 is once reduced at a sufficiently low deceleration rate to the predetermined peripheral speed capable of sufficiently suppressing the irregular scattering of toner. Then, after the airflow is stabilized by the deceleration to the predetermined peripheral speed, the drive of the developing sleeve 42 is stopped. With this action, the irregular scattering of toner can be suppressed during the stopping operation for the developing device 4. In the following, more detailed description is made.

In order to reduce the scattered toner amount during the stopping operation for the developing device 4, it is desired that the developing sleeve 42 be decelerated slowly from the state of high-speed rotation to the predetermined peripheral speed at which the scattered toner amount is sufficiently reduced, and thereafter the developing sleeve 42 be completely stopped. The scattered toner amount changes by powers of the peripheral speed of the developing sleeve 42 (about square in the configuration of the first embodiment). Thus, in order to reduce the scattered toner amount, it is desired that the rapid change in speed on the high-speed side of the developing sleeve 42 be suppressed. Therefore, in the first embodiment, during the stopping operation for the developing device 4, the change in peripheral speed of the developing sleeve 42 immediately after a stop request is set small.

Specifically, in the first embodiment, when the developing sleeve 42 is rotated in the steady state during the image formation, the peripheral speed of the developing sleeve 42 having a diameter of 20 [mm] is 420 [mm/sec]. At this time, the peripheral speed of the photosensitive drum 1 having a diameter of 30 [mm] is 240 [mm/sec]. In the first embodiment, the toner density T/D of the developer is 12%. In the relationship between the peripheral speed of the developing sleeve 42 and the scattered toner amount shown in FIG. 8, a threshold value of the peripheral speed of the developing sleeve 42 capable of sufficiently suppressing the scattering of toner (herein also referred to as "upper limit speed of stoppage") is 280 [mm/sec]. The peripheral speed of the photosensitive drum 1 at this time is 160 [mm/sec]. That is, when the drive of the developing sleeve 42 by the driving unit 120 is stopped from the state in which the peripheral speed of the developing sleeve 42 is equal to or lower than the upper limit speed of stoppage being the predetermined peripheral speed, the scattered toner amount can be sufficiently reduced. As a result, the influence of the scattered toner to the periphery of the developing device 4 can be reduced, thereby being capable of suppressing white lines and fogging of a white base portion. The upper limit speed of stoppage is not limited to the value of the first embodiment, and may suitably be set so that the scattering of toner can be sufficiently suppressed.

In the first embodiment, as illustrated in FIG. 9, until the peripheral speed of the developing sleeve 42 is reduced from 420 [mm/sec] to 280 [mm/sec], the driving speed of the developing sleeve 42 by the driving unit 120 is reduced while setting the deceleration rate to be higher as the peripheral speed is lower. Then, when the peripheral speed of the developing sleeve 42 reaches 280 [mm/sec], the drive of the developing sleeve 42 by the driving unit 120 is stopped. When the drive of the developing sleeve 42 is stopped, the developing sleeve 42 is decelerated at the deceleration rate higher than the previous deceleration rate, and is completely stopped at last.

Herein, the deceleration rate of the peripheral speed of the developing sleeve 42 corresponds to the amount of reduction in peripheral speed of the developing sleeve 42 with respect to the elapse of time (negative acceleration). In the first embodiment, the deceleration rate is expressed by a coefficient to be integrated to a square value of the time for stopping drive from start of deceleration to complete stopping. However, the deceleration rate is not limited thereto, and may be a coefficient of an exponential formula or a coefficient of a logarithmic formula. Further, the driving speed of the developing sleeve 42 by the driving unit 120 corresponds to the rotational speed of the developing sleeve 42 under the state in which the driving unit 120 transmits the driving force to the developing sleeve 42, that is, the state in which the developing sleeve 42 is rotated at an arbitrary rotational speed. This driving speed typically corresponds to the rotational speed of the drive shaft of the drive source under the state in which the driving force is transmitted.

Figure 10:
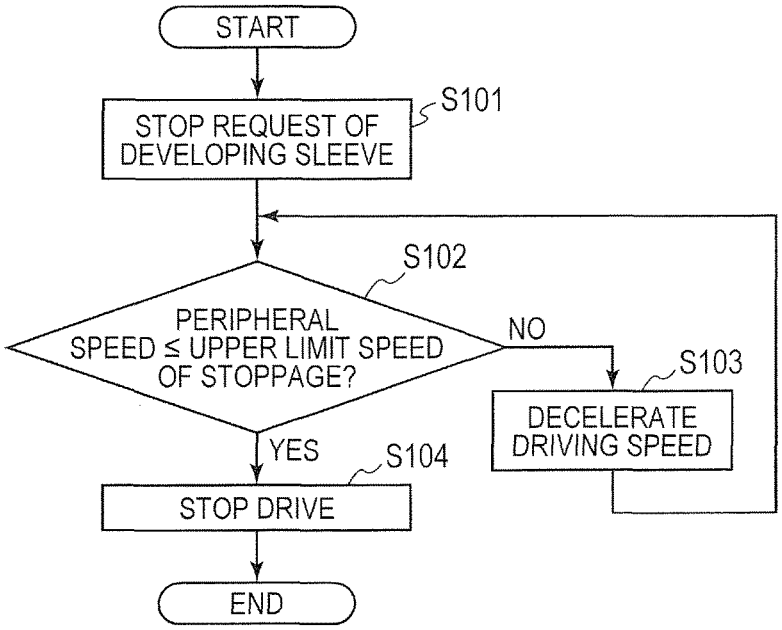
FIG. 10 is an illustration of a flow of the stopping operation for the developing device in the first embodiment.

FIG. 10 is an illustration of a flow of the stopping operation for the developing device 4. When the stop request of the developing sleeve 42 is received (Step S101) at the time of terminating a job (after termination of the image forming operation), the control unit 150 determines whether or not the peripheral speed of the developing sleeve 42 is higher than the upper limit speed of stoppage (predetermined rotational speed) (Step S102). The job is a series of operations of forming an image on a single recording material S or a plurality of recording materials S in accordance with one start instruction and outputting the same. The control unit 150 reduces the driving speed of the developing sleeve 42 by the driving unit 120 (Step S103) at a preset deceleration rate (deceleration rate is higher as speed is lower) until the peripheral speed of the developing sleeve 42 reaches the upper limit speed of stoppage. Then, when the peripheral speed of the developing sleeve 42 by the driving unit 120 reaches the upper limit speed of stoppage (set rotational speed), the control unit 150 stops the drive of the developing sleeve 42 by the driving unit 120 (DC motor is turned off) (Step S104).

The peripheral speed of the developing sleeve 42 can be obtained based on, for example, a detection result given by a rotational speed detecting unit configured to detect a rotational speed of the DC motor of the driving unit 120. As the rotational speed detecting unit, there may be used a suitable mechanism that is available, that is, a mechanism configured to detect a rotational speed of a drive shaft with an encoder, or a mechanism configured to electrically detect the rotational speed of the drive shaft. A peripheral speed of the developing sleeve 42 at each timing in an operation sequence of the image forming apparatus 100 can be obtained in advance. Therefore, the stopping operation of the first embodiment can be performed by performing the stopping operation for the developing device 4 in accordance with a stopping pattern set in advance.

In the first embodiment, during the stopping operation, the control unit 150 reduces the driving speed of the developing sleeve 42 by the driving unit 120 until the peripheral speed of the developing sleeve 42 reaches a predetermined peripheral speed. With this action, the control unit 150 reduces the peripheral speed of the developing sleeve 42 at a first deceleration rate. Then, the control unit 150 stops the drive of the developing sleeve 42 by the driving unit 120 after the peripheral speed of the developing sleeve 42 reaches the predetermined peripheral speed. With this action, the control unit 150 reduces the peripheral speed of the developing sleeve 42 at a second deceleration rate higher than the first deceleration rate and stops the developing sleeve 42. In the first embodiment, the first deceleration rate is set so that the deceleration rate is higher as the peripheral speed of the developing sleeve 42 is lower.

6. Comparison and Review

Comparison was made between the configuration of the first embodiment and a configuration of a comparative example with regard to the scattered toner amount from the developing device 4 during the stopping operation for the developing device 4. The configuration of the comparative example is substantially the same as the configuration of the first embodiment except for that the configuration of the comparative example does not perform the operation of reducing the driving speed of the developing sleeve 42 by the driving unit 120 during the stopping operation for the developing device 4.

For comparison of the scattered toner amount during the stopping operation for the developing device 4, the following test was performed. There was used developer having been subjected to an image formation durability test under a high-temperature and high-humidity environment. The toner density T/D of the developer was set to 12%. In order to repeat the stopping operation for the developing device 4, 100 sheets of solid images are output through an intermittent operation. The intermittent operation is an operation of repeating an operation of stopping an operation of the device for each image output. After that, the developing device 4 was taken out from the image forming apparatus 100, and the amount of adhesion of toner around the developing device 4 was compared.

As a result, with the configuration of the comparative example, there was found adhesion of toner to the upper lid 41*i* of the developing device 4 or a flange of the developing sleeve 42 at a level at which adhesion of toner to the charging roller 2 or the exposing device 3 is concerned when the image formation was performed for a long period of time. In contrast, with the configuration of the first embodiment, no adhesion of toner at a level of causing problems was found.

As described above, according to the first embodiment, the scattering of toner from the developing device 4 during the stopping operation for the developing device 4 can be suppressed. As a result, the adhesion of toner to the periphery of the developing device 4 can be suppressed for a long period of time, and image failures such as white lines and fogging on a white base portion can be suppressed.

Second Embodiment

Next, another embodiment of the present invention is described. The basic configuration and operation of an image forming apparatus of a second embodiment are the same as those of the first embodiment. Thus, in the image forming apparatus according to the second embodiment, components having functions or configurations that are the same as or correspond to those of the image forming apparatus according to the first embodiment are denoted by the same reference symbols as those of the first embodiment, and detailed description thereof is omitted.

1. Overview of Second Embodiment

In the second embodiment, the toner density T/D of developer in the developing device 4 is detected, and a stopping pattern of the developing sleeve 42 during the stopping operation for the developing device 4 is optimized in accordance with the detected toner density T/D. With regard to the stopping pattern of the developing sleeve 42, at least one of the upper limit speed of stoppage or the deceleration rate to the upper limit speed of stoppage can be optimized. In the second embodiment, the deceleration rate to the upper limit speed of stoppage is optimized.

Figure 11:
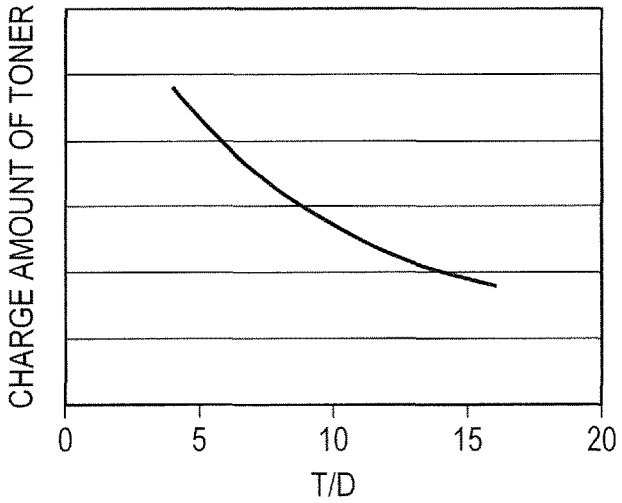
FIG. 11 is a graph for showing a relationship between a toner density of developer and a scattered toner amount.
Figure 12:
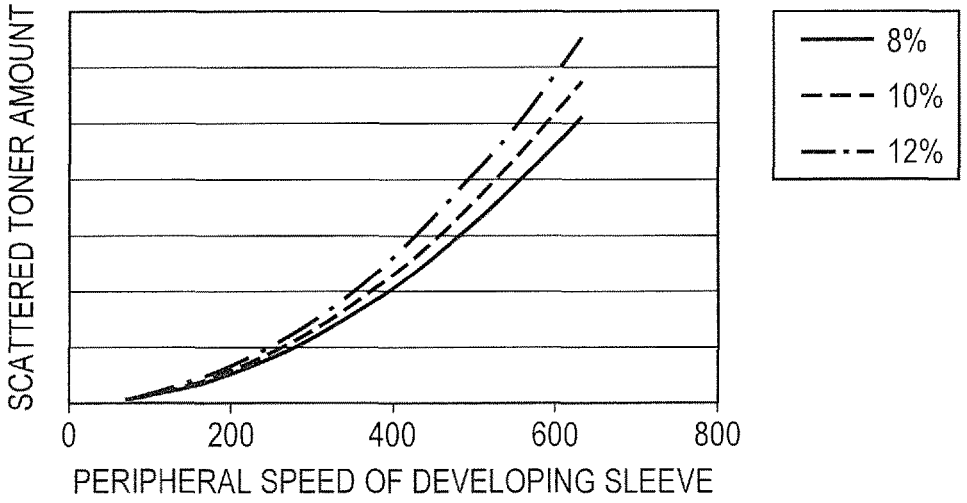
FIG. 12 is a graph for showing a relationship between a peripheral speed of the developing sleeve and a charge amount of toner for each toner density of developer.

As described in the first embodiment, the separation of toner from carrier is caused by factors such as an impact and a centrifugal force. As a force being adverse to the impact and the centrifugal force, there is given an adhesion force between toner and carrier. The adhesion force may be an electrostatic adhesion force such as a coulomb force or a non-electrostatic adhesion force such as a liquid bridge force, but the electrostatic adhesion force is dominant. Charge amounts of toner and carrier are determined in accordance with a contact probability of toner with respect to carrier, and the charge amount is larger as the toner density T/D is lower. FIG. 11 is a graph for showing a relationship between the toner density T/D and the charge amount of toner. As shown in FIG. 11, the charge amount of toner is substantially in inverse proportion to the toner density T/D. Further, under a state in which the toner density T/D is high, a covering ratio of toner with respect to carrier is higher, and hence toner which cannot adhere to a surface of carrier is liable to be separated. For example, in a case in which a particle diameter of toner is 5 μm, and a particle diameter of carrier is 40 μm, the covering ratio exceeds 100% when the toner density T/D exceeds 12%. FIG. 12 is a graph for showing a relationship between the peripheral speed of the developing sleeve 42 and the scattered toner amount in each of cases in which the toner densities T/D are 8%, 10%, and 12%. From FIG. 12, it can be found that the scattering of toner is liable to occur as the toner density T/D is higher. Therefore, it is desired that the deceleration rate to the upper limit speed of stoppage be set lower as the toner density T/D is higher.

When the deceleration rate of the developing sleeve 42 is set lower, the time for stopping drive is increased, and hence developer may be degraded faster. Therefore, under a condition in which the scattering of toner is less liable to occur, it is desired that the deceleration rate to the upper limit speed of stoppage be set higher to shorten the time for stopping drive (idling time) of the developing sleeve 42.

2. Toner Replenishment Control

Description is made of a toner replenishment control for the developing device 4. The image forming apparatus 100 performs an Auto Toner Replenisher (ATR) control of replenishing toner of an amount corresponding to consumption by development to the developing device 4. In the second embodiment, the ATR control of the following type is employed in order to stabilize the density of an output image. The control unit 150 controls the number of revolutions of the replenishment screw of the toner hopper 8 and replenishes toner to the developer container 41 in accordance with a printing rate (image area ratio) during image formation, a detection result given by the inductance sensor 47, and a detection result of an image density of a patch image. That is, the control unit 150 obtains a toner replenishment amount corresponding to a toner consumption amount estimated from the printing rate during the image formation. Further, based on the detection result given by the inductance sensor 47, the control unit 150 corrects the toner replenishment amount based on the printing rate. Further, with use of the result of the density of the patch image formed at a predetermined frequency, the control unit 150 corrects a target value of the detection result given by the inductance sensor 47. In the second embodiment, rather than replenishing toner of a suitable replenishment amount as required, replenishment is restrained until the replenishment amount reaches a preset amount for one time (in the second embodiment, one rotation of the replenishment screw of the toner hopper 8), and the replenishment screw is rotated one time for each replenishment amount for one time. With this configuration, a stable replenishment amount can be obtained.

More in detail, the image processing unit 153 of the control unit 150 calculates the toner consumption amount resulting from image formation based on image information received from an image reading device or from a personal computer connected through a network. In the second embodiment, the toner consumption amount is obtained from a printing rate based on a video count value (image signal value) integrated based on the image information, and is integrated for each image output. The replenishment control unit 152 of the control unit 150 obtains the toner amount corresponding to the toner consumption amount as a toner replenishment amount. However, when the toner density T/D detected by the inductance sensor 47 is deviated from the target value of the toner density T/D, the replenishment control unit 152 corrects the toner replenishment amount so as to reduce the deviation. Then, when the obtained replenishment amount is equal to or larger than the replenishment amount for one rotation of the replenishment screw of the toner hopper 8, the replenishment control unit 152 rotates the replenishment screw by the required number of revolutions, to thereby replenish toner to the developing device 4.

The replenishment control unit 152 forms a patch image, which has a predetermined size (for example, 15 mm square) with a predetermined latent image contrast, on the photosensitive drum 1 at a predetermined frequency (for example, for each predetermined number of image output), and causes the patch image to be transferred to the intermediate transfer belt 51. Then, the replenishment control unit 152 causes the image density (reflection density) of the patch image to be measured on the intermediate transfer belt 51 by an optical sensor 54 (FIG. 1 and FIG. 5) being an image density detecting unit. Then, the replenishment control unit 152 compares the measured image density with a reference image density, and changes the target value of the toner density T/D so as to reduce the deviation of the image density (patch detection control). With this operation, the charge amount of toner is estimated from the amount of toner used for the formation of the patch image, thereby being capable of dealing with the change in image density caused by the change in charge amount of toner due to degradation of carrier.

This ATR control itself is well-known, and any suitable method may be used as needed in the present invention. Therefore, further detailed description is omitted.

3. Suppression of Scattering of Toner

In the second embodiment, the control unit 150 changes the deceleration rate to the upper limit speed of stoppage in accordance with the detection result of the toner density T/D by the inductance sensor 47. In the second embodiment, the control unit 150 performs a control so that the deceleration rate to the upper limit speed of stoppage is set lower by stages as the toner density T/D is higher. In particular, in the second embodiment, the control unit 150 changes the deceleration rate to the upper limit speed of stoppage in accordance with an average value of the detection result of the toner density T/D given by the inductance sensor 47 from the patch detection control immediately before the end of the job to immediately before the job. That is, in the second embodiment, there is used an average value of the detection result of the toner density T/D at the time of stopping the drive of the developing device 4 under a state in which the target value of the toner density T/D is set to the latest value. When the patch detection control is performed immediately after the end of the job, the detection result of the toner density T/D after the patch detection control is disregarded. The detection result of the toner density T/D at any suitable timing can be used when the detection result can be used as an index indicating the possibility of causing the scattering of toner during the stopping operation for the developing device 4.

Figure 13:
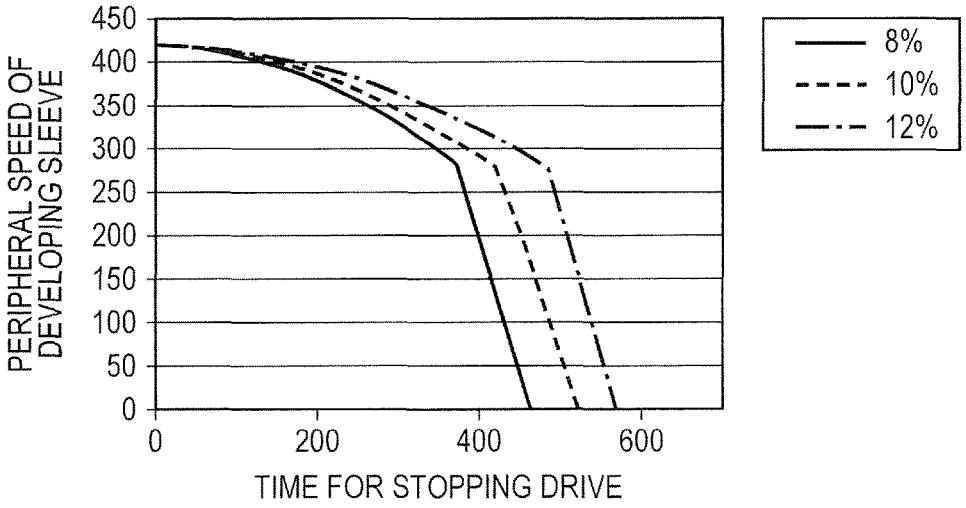
FIG. 13 is a graph for explaining a stopping operation for the developing device in a second embodiment of the present invention.

FIG. 13 is a graph for showing a relationship between the time for stopping drive from the state in which the developing sleeve 42 is rotated in a steady state to the stop and the peripheral speed of the developing sleeve 42 in the second embodiment. In the second embodiment, the deceleration rate to the upper limit speed of stoppage is set lower by stages in a case in which the toner density T/D is equal to or higher than 8% and lower than 10% (solid line in FIG. 13), a case in which the toner density T/D is equal to or higher than 10% and lower than 12% (broken line in FIG. 13), and a case in which the toner density T/D is equal to or higher than 12% (one-dot chain line in FIG. 13). In the second embodiment, with regard to the deceleration rate to the upper limit speed of stoppage in each case, the deceleration rate is set higher as the peripheral speed is lower until the upper limit speed of stoppage is reached.

Figure 14:
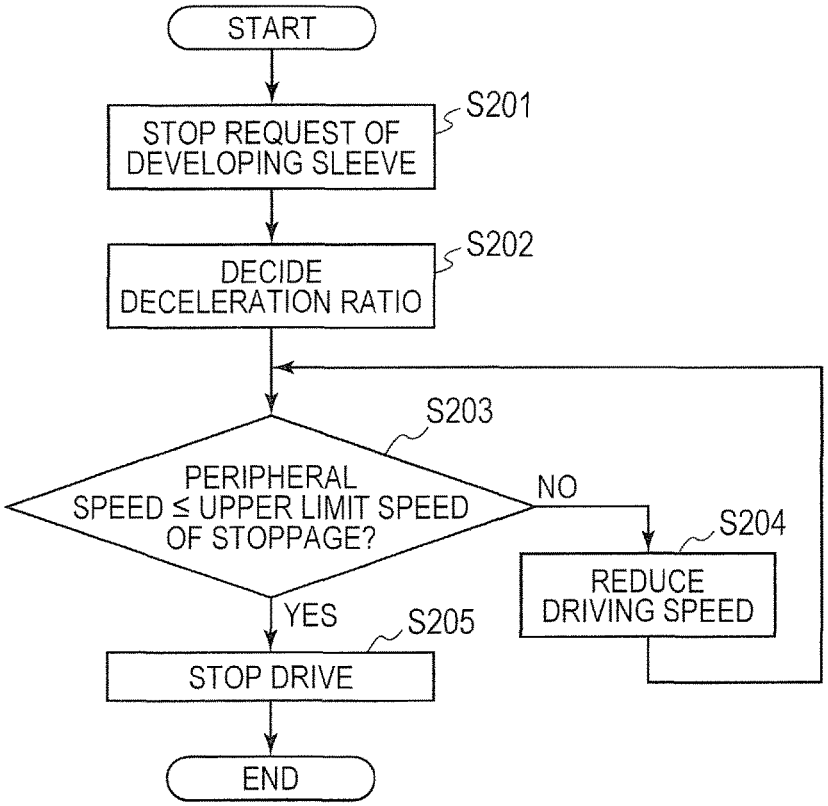
FIG. 14 is an illustration of a flow of the stopping operation for the developing device in the second embodiment.

FIG. 14 is a flowchart for illustrating a flow of the stopping operation for the developing device 4 in the second embodiment. When the stop request of the developing sleeve 42 is given, for example, at the time of terminating a job (Step S201), the control unit 150 determines the deceleration rate to the upper limit speed of stoppage based on the detection result of the toner density T/D (Step S202). After that, the control unit 150 determines whether or not the peripheral speed of the developing sleeve 42 is higher than the upper limit speed of stoppage (Step S203). The control unit 150 reduces the driving speed of the developing sleeve 42 by the driving unit 120 at the determined deceleration rate (setting the deceleration rate to be higher as the speed is lower) until the peripheral speed of the developing sleeve 42 reaches the upper limit speed of stoppage (Step S204). Then, when the peripheral speed of the developing sleeve 42 reaches the upper limit speed of stoppage, the control unit 150 stops the drive of the developing sleeve 42 by the driving unit 120 (DC motor is turned off) (Step S205).

In the second embodiment, the image forming apparatus 100 includes the inductance sensor 47 configured to detect the toner density as a density detecting unit configured to detect a density of developer contained in the developer container 41. In the second embodiment, the control unit 150 changes the deceleration rate (first deceleration rate) to the upper limit speed of stoppage in accordance with the detection result given by the inductance sensor 47. In the second embodiment, the control unit 150 reduces the first deceleration rate given in the case in which the toner density is at a second density higher than the first density, rather than the first deceleration rate given in the case in which the toner density is at the first density.

With the configuration of the second embodiment, a test was performed to study a level of scattering of toner similar to the case of the first embodiment with the toner density T/D set to 8%, 10%, and 12%. As a result, when the toner density T/D was 8% which was relatively low, there could be found no adhesion of toner to the periphery of the developing device 4 at a level of causing problems even when the deceleration rate to the upper limit speed of stoppage was set relatively higher. In the case of the toner density T/D of 12% which was relatively high, there could be found no adhesion of toner to the periphery of the developing device 4 at a level of causing problems when the deceleration rate to the upper limit speed of stoppage was set relatively low. In any of the cases with those toner densities T/D, the amount of adhesion of toner to the periphery of the developing device 4 was substantially equal.

As described above, according to the second embodiment, even under a condition in which the scattering of toner from the developing device 4 during the stopping operation for the developing device 4 is liable to occur, the scattering of toner can be sufficiently suppressed. Further, according to the second embodiment, under a condition in which the scattering of toner from the developing device 4 during the stopping operation for the developing device 4 is less liable to occur, the scattering of toner can be suppressed while suppressing the excessive increase in time for stopping drive of the developing sleeve 42.

As long as the scattering of toner during the stopping operation for the developing device 4 is not at the level of causing problems, the operation of reducing the driving speed of the developing sleeve 42 by the driving unit 120 may be omitted in the case in which the toner density T/D is lower than a predetermined value (for example, 8%).

The range of the toner density T/D (interval width) for changing the deceleration rate is not limited to the range of the second embodiment, and may suitably be set so that the scattering of toner can be sufficiently suppressed.

The density detecting unit configured to detect the density of developer contained in the developer container 41 is not limited to the inductance sensor, and any suitable unit may be used as needed. For example, there may be used the toner consumption amount based on image information, or the density of developer indirectly obtained based on information such as the toner replenishment amount.

Third Embodiment

Next, another embodiment of the present invention is described. The basic configuration and operation of an image forming apparatus of a third embodiment of the present invention are the same as those of the first embodiment. Thus, in the image forming apparatus according to the third embodiment, components having functions or configurations that are the same as or correspond to those of the image forming apparatus according to the first embodiment are denoted by the same reference symbols as those of the first embodiment, and detailed description thereof is omitted.

1. Overview of Third Embodiment

In the third embodiment, an environment in an atmosphere of developer is detected (measured or estimated), and the stopping pattern of the developing sleeve 42 during the stopping operation for the developing device 4 is optimized in accordance with the detected environment. The environment is typically at least one of a temperature or a humidity in at least one of the inside and the outside of the developing device 4. In the third embodiment, the temperature and the humidity in the developing device 4 are detected to obtain a relative humidity, and the stopping pattern of the developing sleeve 42 is optimized in accordance with the relative humidity. Further, in the third embodiment, as the stopping pattern of the developing sleeve 42, the deceleration rate to the upper limit speed of stoppage is optimized similarly to the second embodiment.

Figure 15:
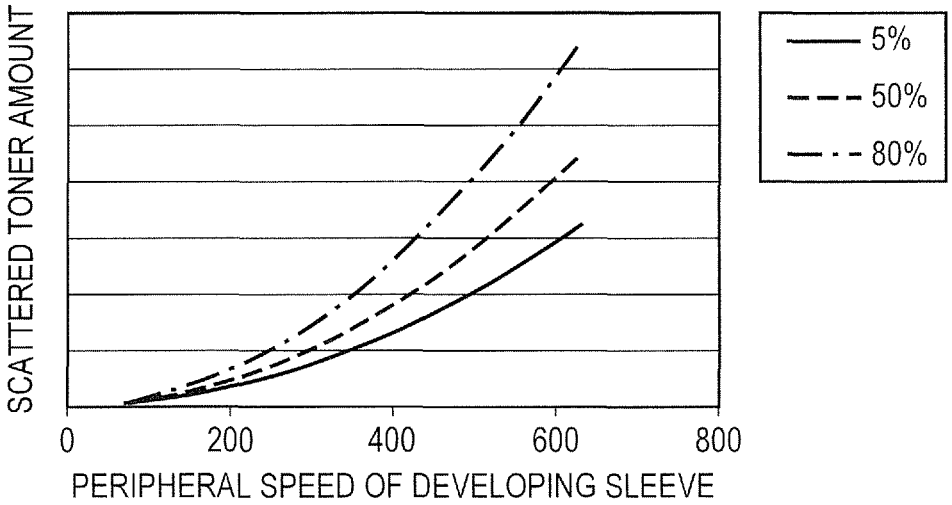
FIG. 15 is a graph for showing a relationship between a peripheral speed of the developing sleeve and a scattered toner amount for each relative humidity.

In relation to the electrostatic adhesion force between toner and carrier described in the second embodiment, the charge amounts of toner and carrier change in accordance with the relative humidity of the atmosphere in which the developer is placed. Therefore, in a normal-temperature and normal-humidity environment, or in a low-humidity environment, the charge amount is increased, and hence the scattering of toner is less liable to occur. In a high-humidity environment, the charge amount is reduced, and hence the scattering of toner is liable to occur. FIG. 15 is a graph for showing a relationship between the peripheral speed of the developing sleeve 42 and the scattered toner amount in each of the cases in which the relative humidity in the developing device 4 is 5%, 50%, and 80%. From FIG. 15, it can be found that the scattering of toner is liable to occur as the relative humidity in the developing device 4 is higher. Thus, it is desired that the deceleration rate to the upper limit speed of stoppage be set lower as the relative humidity in the developing device 4 is higher.

Similarly to the case of the second embodiment, under the condition in which the scattering of toner is less liable to occur, it is desired that the deceleration rate to the upper limit speed of stoppage be set higher to shorten the time for stopping drive (idling time) of the developing sleeve 42.

2. Suppression of Scattering of Toner

In the third embodiment, as an environment detecting unit, the temperature and humidity sensor 60 (FIG. 5), which is configured to detect the temperature and the humidity in the developing device 4, is provided in the developing device 4. The control unit 150 obtains a relative humidity of the atmosphere of developer in the developing device 4 based on a detection result of temperature and humidity input from the temperature and humidity sensor 60.

In the third embodiment, when the obtained relative humidity is equal to or higher than 45%, the control unit 150 changes the deceleration rate to the upper limit speed of stoppage in accordance with a value of the relative humidity. In the third embodiment, the control unit 150 performs the control so that the deceleration rate to the upper limit speed of stoppage is set lower by stages as the relative humidity is higher. Meanwhile, in the third embodiment, when the obtained relative humidity is lower than 45%, the control unit 150 does not perform the operation of reducing the driving speed of the developing sleeve 42 by the driving unit 120 during the stopping operation for the developing device 4.

Figure 16:
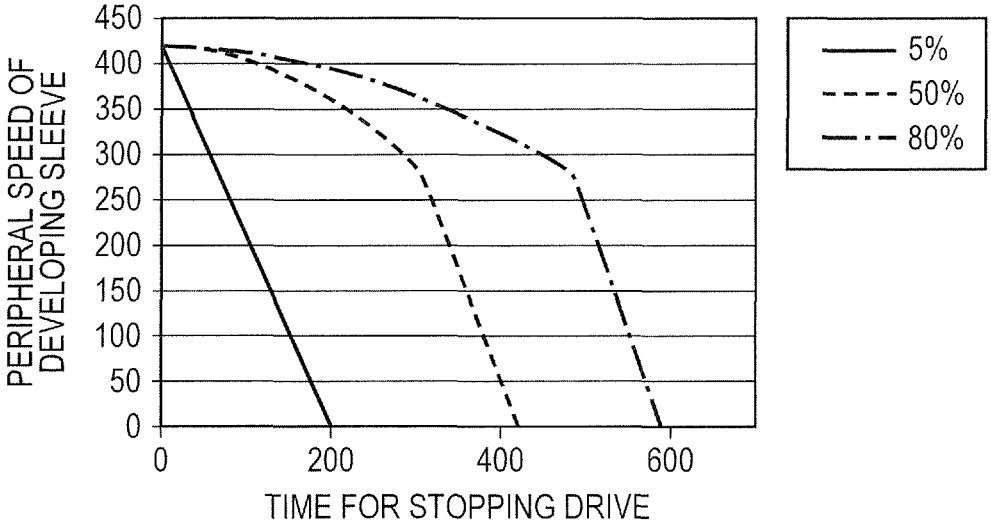
FIG. 16 is a graph for explaining a stopping operation for the developing device in a third embodiment of the present invention.

FIG. 16 is a graph for showing a relationship between the time for stopping drive from the state in which the developing sleeve 42 is rotated in the steady state to the stop and the peripheral speed of the developing sleeve 42 in the third embodiment. In the third embodiment, the relative humidity in the image forming apparatus 100 is controlled so as to fall within the range of from 5% to 80%. In the third embodiment, when the relative humidity is lower than 45% (solid line in FIG. 16), the drive of the developing sleeve 42 is simply stopped (DC motor is turned off) during the stopping operation for the developing device 4. Further, in the third embodiment, when the relative humidity is equal to or higher than 45% and equal to or lower than 80%, the deceleration rate to the upper limit speed of stoppage is set lower by stages at predetermined interval widths as the relative humidity is higher. In FIG. 16, only 50% (broken line) and 80% (one-dot chain line) are shown as representative examples. In the third embodiment, with regard to the deceleration rate to the upper limit speed of stoppage in the case in which the relative humidity is equal to or higher than 45%, the deceleration rate is increased as the peripheral speed is reduced until the upper limit speed of stoppage is reached.

A flow of the stopping operation for the developing device 4 in the third embodiment is the same as the case of the second embodiment illustrated in FIG. 14. However, in the third embodiment, in Step S202, the control unit 150 determines the deceleration rate to the upper limit speed of stoppage, or determines that the operation of reducing the driving speed of the developing sleeve 42 by the driving unit 120 is not to be performed, based on the detection result of the relative humidity in the atmosphere of developer.

In the third embodiment, the image forming apparatus 100 includes the temperature and humidity sensor 60 configured to detect the relative humidity in the developer container 41 as an environment detecting unit configured to detect the environment of the atmosphere of the developer contained in the developer container 41. In the third embodiment, the control unit 150 changes the deceleration rate (first deceleration rate) to the upper limit speed of stoppage in accordance with the detection result of the temperature and humidity sensor 60. In the third embodiment, the control unit 150 reduces the first deceleration rate given in a case in which the humidity of the environment is at a second humidity higher than a first humidity, rather than the first deceleration rate given in a case in which the humidity of the environment is at the first humidity.

With the configuration of the third embodiment, a test was performed to study a level of scattering of toner similar to the case of the first embodiment with the relative humidity set within the range of from 5% to 80%. As a result, when the relative humidity was lower than 45%, even without performing the operation of reducing the driving speed of the developing sleeve 42, there could be found no adhesion of toner to the periphery of the developing device 4 at a level of causing problems. Further, in the case in which the relative humidity fell within the range of from 45% to 80%, when the deceleration rate to the upper limit speed of stoppage was set higher as the relative humidity was higher, there could be found no adhesion of toner to the periphery of the developing device 4 at a level of causing problems. In any of the cases, the amount of adhesion of toner to the periphery of the developing device 4 was substantially equal.

As described above, according to the third embodiment, the scattering of toner from the developing device 4 during the stopping operation for the developing device 4 can be suppressed while suppressing the excessive increase in time for stopping drive of the developing sleeve 42.

In the third embodiment, there is described an example in which the relative humidity in the developing device 4 is directly detected. However, for example, the temperature and humidity outside the apparatus main body 110 and the temperature of the developing device 4 may be detected to calculate (estimate) the humidity in the developing device 4. When the possibility of causing scattering of toner during the stopping operation for the developing device 4 correlates with the temperature in the environment of the atmosphere of the developer, typically, the control unit 150 may be set so as to change the deceleration rate (first deceleration rate) to the upper limit speed of stoppage as follows. That is, it is only necessary that the first deceleration rate in the case in which the temperature of the environment is at a second temperature higher than a first temperature be lowered rather than the first deceleration rate in the case in which the temperature of the environment is at the first temperature.

The control in accordance with the toner density T/D, which is described in the second embodiment, and the control in accordance with the relative humidity, which is described in the third embodiment, may be combined. In this case, it is only necessary that the deceleration rate to the upper limit speed of stoppage for each toner density T/D within a predetermined range be set for each of the relative humidity of the predetermined interval width. For example, when the relative humidity is lower than a predetermined value (for example, 45%), and the toner density T/D is lower than a predetermined value (for example, 8%), the operation of reducing the driving speed of the developing sleeve 42 by the driving unit 120 can be omitted. Then, when the relative humidity is equal to or higher than the predetermined value, and the toner density T/D is equal to or higher than the predetermined value, the operation of reducing the driving speed of the developing sleeve 42 by the driving unit 120 can be performed.

Fourth Embodiment

Next, another embodiment of the present invention is described. The basic configuration and operation of an image forming apparatus of a fourth embodiment of the present invention are the same as those of the first embodiment. Thus, in the image forming apparatus according to the fourth embodiment, components having functions or configurations that are the same as or correspond to those of the image forming apparatus according to the first embodiment are denoted by the same reference symbols as those of the first embodiment, and detailed description thereof is omitted.

1. Overview of Fourth Embodiment

In the fourth embodiment, the stopping pattern of the developing sleeve 42 during the stopping operation for the developing device 4 is optimized in accordance with image information. More specifically, in the fourth embodiment, as an index indicating the possibility of causing the scattering of toner in the developer container 41 due to the toner replenishment, a printing rate obtained from a video count value (image signal value) integrated based on the image information is used. Further, in the fourth embodiment, as the stopping pattern of the developing sleeve 42, the deceleration rate to the upper limit speed of stoppage is optimized similarly to the second embodiment and the third embodiment.

Figure 17:
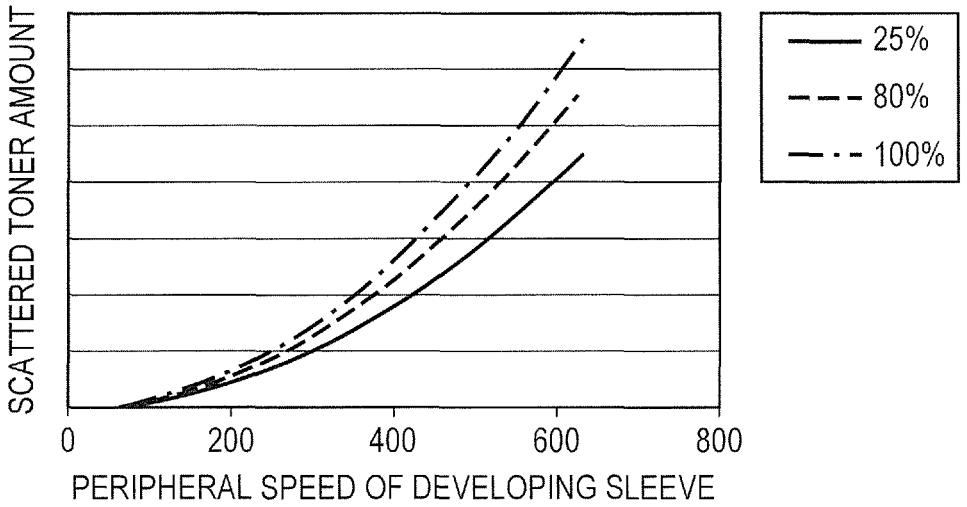
FIG. 17 is a graph for showing a relationship between a peripheral speed of the developing sleeve and a scattered toner amount for each printing rate.

As described in the first embodiment, as a factor causing the scattering of toner, there has been known a state in which the toner replenished to the developer container 41 is agitated by the second screw 46 before the toner is brought into contact with carrier. When the printing rate (image duty) is 100%, a largest amount of toner is replenished to the developer container 41. In the fourth embodiment, toner of about 0.35 [g] per one image output is replenished. When the detection result of the toner density T/D given by the inductance sensor 47 is lower than the target value of the toner density T/D, the replenishment amount may be further increased, with the result that toner of the amount of about 0.50 [g] at maximum may be replenished per one replenishment. When such toner replenishment is continuously performed, a large amount of toner may be scattered in the developer container 41. Therefore, when the drive of the developing device 4 is stopped in such a condition, air including much toner flows out to the outside of the developer container 41 by the internal pressure of the developer container 41 as described in the first embodiment. FIG. 17 is a graph for showing a relationship between the peripheral speed of the developing sleeve 42 and the scattered toner amount in each of the cases in which the average printing rates in the job immediately before the stopping operation for the developing device 4 are 25%, 80%, and 100%. From FIG. 17, it can be found that the scattering of toner is liable to occur as the printing rate is higher. Thus, it is desired that the deceleration rate to the upper limit speed of stoppage be set lower as the printing rate is higher.

Similarly to the cases of the second embodiment and the third embodiment, under the condition in which the scattering of toner is less liable to occur, it is desired that the deceleration rate to the upper limit speed of stoppage be set higher to shorten the time for stopping drive (idling time) of the developing sleeve 42.

2. Suppression of Scattering of Toner

In the fourth embodiment, the control unit 150 changes the deceleration rate to the upper limit speed of stoppage in accordance with the printing rate. In the fourth embodiment, the control unit 150 performs a control so that the deceleration rate to the upper limit speed of stoppage is set lower by stages as the printing rate is higher. In particular, in the fourth embodiment, the control unit 150 calculates an average printing rate in the job from the start of the drive of the developing device 4 to the start of the drive stopping operation, and changes the deceleration rate to the upper limit speed of stoppage in accordance with the average printing rate. The average printing rate can be obtained by dividing an integration value of the printing rate per image output in the job by the number of image output in the job.

In the fourth embodiment, the replenishment amount for one rotation of the replenishment screw of the toner hopper 8 is 0.175 [g]. For one image output with a printing rate of 100%, the replenishment amount corresponding to two rotations of the replenishment screw is required. As a criterion, when the average printing rate is lower than 50%, the replenishment amount corresponding to zero to one rotation is required for one image output. When the average printing rate is from 50% to 99%, the replenishment amount corresponding to one to three rotations is required for one image output. When the average printing rate is 100%, the replenishment amount corresponding to two to three rotations is required for one image output.

Figure 18:
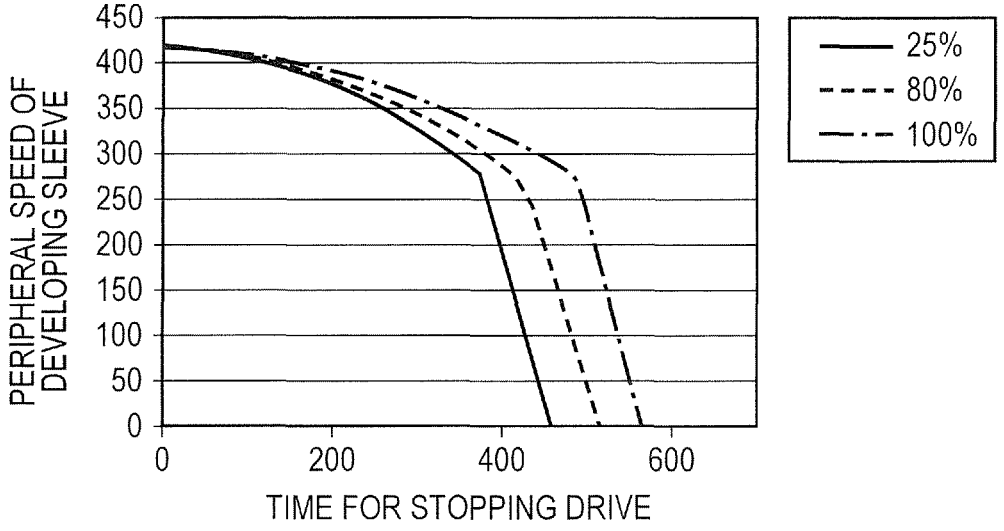
FIG. 18 is a graph for explaining a stopping operation for the developing device in a fourth embodiment of the present invention.

FIG. 18 is a graph for showing a relationship between the time for stopping drive from the state in which the developing sleeve 42 is rotated in a steady state to the stop and the peripheral speed of the developing sleeve 42 in the fourth embodiment. In the fourth embodiment, the deceleration rate to the upper limit speed of stoppage is set lower by stages in a case in which the printing rate is lower than 50% (solid line in FIG. 18), a case in which the printing rate is equal to or higher than 50% and lower than 100% (broken line in FIG. 18), and a case in which the printing rate is equal to 100% (one-dot chain line in FIG. 18). Further, in the fourth embodiment, with regard to the deceleration rate to the upper limit speed of stoppage in each case, the deceleration rate is set higher as the peripheral speed is lower until the upper limit speed of stoppage is reached.

A flow of the stopping operation for the developing device 4 in the fourth embodiment is the same as the case of the second embodiment illustrated in FIG. 14. However, in the fourth embodiment, in Step S202, the control unit 150 determines the deceleration rate to the upper limit speed of stoppage based on the calculation result of the average printing rate.

In the fourth embodiment, the image forming apparatus 100 includes an image processing unit 153 as a processing unit configured to obtain a printing rate of an output image. In the fourth embodiment, the control unit 150 changes the deceleration rate (first deceleration rate) to the upper limit speed of stoppage in accordance with the printing rate obtained by the image processing unit 153. In the fourth embodiment, the control unit 150 reduces the first deceleration rate given in a case in which the printing rate is at a second printing rate higher than a first printing rate, rather than the first deceleration rate given in the case in which the printing rate is at the first printing rate.

With the configuration of the fourth embodiment, a test was performed to study a level of scattering of toner similar to the case of the first embodiment with the printing rate set to 25%, 80%, and 100%. As a result, when the printing rate was 25% which was relatively low, there could be found no adhesion of toner to the periphery of the developing device 4 at a level of causing problems even when the deceleration rate to the upper limit speed of stoppage was set relatively higher. In the case of the printing rate of 100% which was high, there could be found no adhesion of toner to the periphery of the developing device 4 at a level of causing problems when the deceleration rate to the upper limit speed of stoppage was set relatively low. In any of the cases with those printing rates, the amount of adhesion of toner to the periphery of the developing device 4 was substantially equal.

As described above, according to the fourth embodiment, the scattering of toner from the developing device 4 during the stopping operation for the developing device 4 can be suppressed while suppressing the excessive increase in time for stopping drive of the developing sleeve 42.

As described in the second embodiment, in the fourth embodiment, the toner replenishment amount based on the printing rate may be increased or decreased in accordance with the detection result given by the inductance sensor 47. Therefore, the deceleration rate to the upper limit speed of stoppage, which is determined in accordance with the printing rate, can be corrected in accordance with the detection result given by the inductance sensor 47. For example, when the replenishment amount is increased in accordance with the detection result given by the inductance sensor 47, the deceleration rate to the upper limit speed of stoppage may be set lower in accordance with the amount of increase. In contrast, when the replenishment amount is reduced in accordance with the detection result given by the inductance sensor 47, the deceleration rate to the upper limit speed of stoppage may be set higher in accordance with the amount of the reduction. With this configuration, a control which is more suitable for the condition of scattering of toner in the developer container 41 can be performed.

When a job which continues for a long period of time over a certain time period (continuous image formation) is executed, an average printing rate for a former half of the job has relatively smaller influence on the scattering of toner in the developer container 41 during the stopping operation for the developing device 4. Therefore, at the time of terminating the job in the case in which the job which continues for a long period of time over a certain time period (continuous image formation) is executed, the average printing rate during a certain period immediately before terminating the job is calculated, and the deceleration rate to the upper limit speed of stoppage can be determined based on the average printing rate. With this configuration, the control which is suitable for the average printing rate during the predetermined period in a latter half of the job having a relatively larger influence on the scattering of toner in the developer container 41 during the stopping operation for the developing device 4 can be performed.

As long as the scattering of toner during the stopping operation for the developing device 4 is not at the level of causing problems, the operation of reducing the driving speed of the developing sleeve 42 by the driving unit 120 may be omitted in the case in which the printing rate is lower than a predetermined value (for example, 25%).

[Others]

The present invention is described above by way of specific embodiments. However, the present invention is not limited to the embodiments described above.

Figure 19A:
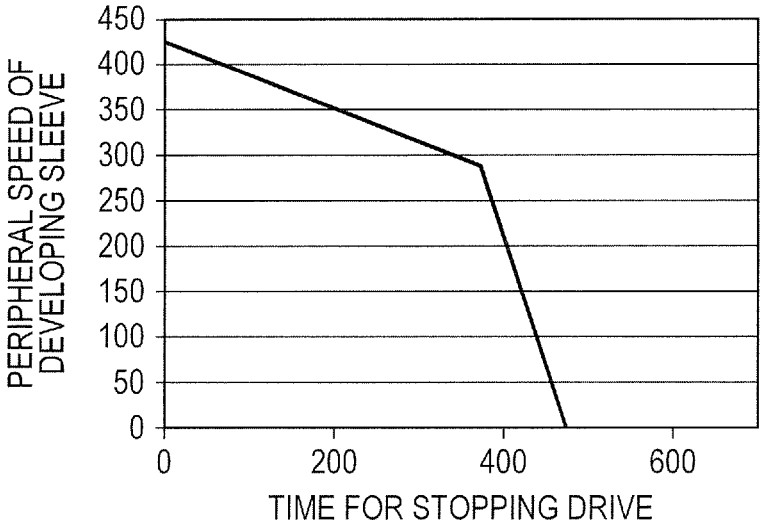
FIG. 19A is a graph for explaining another example of the stopping operation for the developing device.

In the above-mentioned embodiments, the deceleration rate to the upper limit speed of stoppage during the stopping operation for the developing device is set so that the deceleration rate is higher as the peripheral speed of the developing sleeve is lower. With this configuration, the time for stopping drive of the developing sleeve can be shortened as much as possible while a rapid change in peripheral speed under a state in which the peripheral speed of the developing sleeve which is liable to cause scattering of toner is effectively suppressed. However, the present invention is not limited to the above-mentioned embodiments. The deceleration rate to the upper limit speed of stoppage may be substantially constant as shown in, for example, FIG. 19A.

Figure 19B:
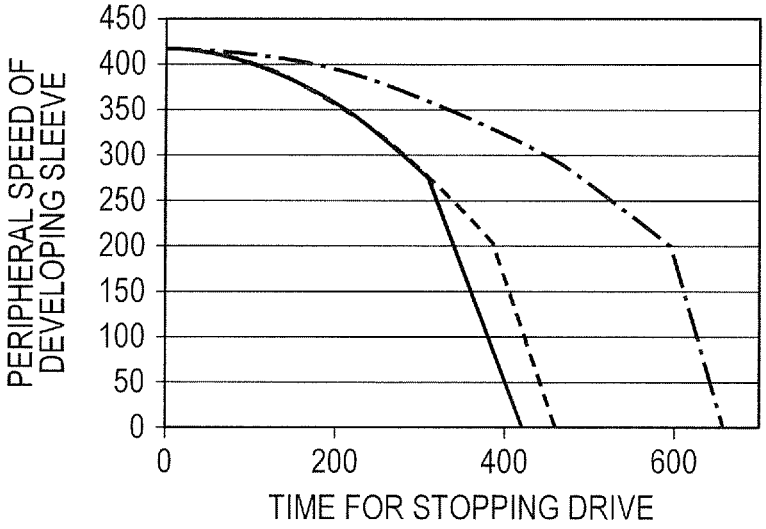
FIG. 19B is a graph for explaining another example of the stopping operation for the developing device.

In the second embodiment to the fourth embodiment, description is made of the example in which the deceleration rate to the upper limit speed of stoppage as the stopping pattern of the developing sleeve is changed in accordance with various indices representing the probability of causing the scattering of toner. However, as the stopping pattern of the developing sleeve, the upper limit speed of stoppage may be changed as indicated by the broken line in FIG. 19B. Further, as indicated by the one-dot chain line in FIG. 19B, both the deceleration rate to the upper limit speed of stoppage and the upper limit speed of stoppage may be changed. When the upper limit speed of stoppage is changed, typically, the upper limit speed of stoppage under the condition in which the scattering of toner during the stopping operation for the developing device is relatively more liable to occur is reduced rather than the upper limit speed of stoppage under the condition in which the scattering of toner during the stopping operation is relatively less liable to occur. As described in the second embodiment to the fourth embodiment, the condition in which the scattering of toner is relatively less liable to occur corresponds to a condition in which the developer density is relatively lower, a condition in which temperature or humidity is relatively lower, or a condition in which a printing rate is relatively lower. The condition in which the scattering of toner is relatively more liable to occur corresponds to a condition in which the developer density is relatively higher, a condition in which temperature or humidity is relatively higher, or a condition in which a printing rate is relatively higher.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-205363, filed Oct. 19, 2016, which is hereby incorporated by reference herein in its entirety.

What is claimed is:

1. An image forming apparatus, comprising:

an image bearing member;

a developer container containing a developer including toner and carrier;

a developing rotary member configured to carry and feed the developer toward a position to develop an electrostatic latent image formed on the image bearing member;

a driving unit configured to rotate the developing rotary member; and a controller configured to control the driving unit, wherein the controller is configured to perform a mode of:

rotating the developing rotary member by the driving unit so that a rotation speed of the developing rotary member becomes a first rotation speed in an image forming period during which an image forming operation is performed, rotating the developing rotary member by the driving unit to decelerate the rotation speed of the developing rotary member from the first rotation speed in a first period of a non-image forming period during which no image forming operation is performed so that the rotation speed of the developing rotary member becomes a second rotation speed lower than the first rotation speed, and stopping a rotation of the developing rotary member by the driving unit to decelerate the rotation speed of the developing rotary member from the second rotation speed in a second period subsequent to the first period of the non-image forming period so that the rotation of the developing rotary member is stopped, and wherein a deceleration amount per unit time of the developing rotary member in the first period is smaller than a deceleration amount per unit time of the developing rotary member in the second period.

2. An image forming apparatus according to claim 1, further comprising an obtaining portion configured to obtain information on a toner density as a ratio of the toner and the carrier of the developer contained in the developer container, wherein the controller determines the deceleration amount per unit time of the developing rotary member in the first period based on the information on the toner density of the developer contained in the developer container obtained by the obtaining portion, and wherein the deceleration amount per unit time of the developing rotary member in the first period when the toner density of the developer contained in the developer container is a second value higher than a first value is lower than the deceleration amount per unit time of the developing rotary member in the first period when the toner density of the developer contained in the developer container is the first value.

3. An image forming apparatus according to claim 2, wherein the controller determines the second rotation speed based on the information on the toner density of the developer contained in the developer container, and wherein the second rotation speed when the toner density of the developer contained in the developer container is the second value is lower than the second rotation speed when the toner density of the developer contained in the developer container is the first value.

4. An image forming apparatus according to claim 1, further comprising an obtaining portion configured to obtain information on a toner density as a ratio of the toner and the carrier of the developer contained in the developer container, wherein the controller determines the second rotation speed based on the information on the toner density of the developer contained in the developer container obtained by the obtaining portion, and wherein the second rotation speed when the toner density of the developer contained in the developer container is a second value higher than a first value is lower than the second rotation speed when the toner density of the developer contained in the developer container is the first value.

5. An image forming apparatus according to claim 1, further comprising an obtaining portion configured to obtain information on a relative humidity in the developer container, wherein the controller determines the deceleration amount per unit time of the developing rotary member in the first period based on the information on the relative humidity in the developer container obtained by the obtaining portion, and wherein the deceleration amount per unit time of the developing rotary member in the first period when the relative humidity in the developer container is a second value higher than a first value is lower than the deceleration amount per unit time of the developing rotary member in the first period when the relative humidity in the developer container is the first value.

6. An image forming apparatus according to claim 5, wherein the controller determines the second rotation speed based on the information on the relative humidity in the developer container obtained by the obtaining portion, and wherein the second rotation speed when the relative humidity in the developer container is the second value is lower than the second rotation speed when the relative humidity in the developer container is the first value.

7. An image forming apparatus according to claim 1, further comprising an obtaining portion configured to obtain information on a relative humidity in the developer container, wherein the controller determines the second rotation speed based on the information on the relative humidity in the developer container obtained by the obtaining portion, and wherein the second rotation speed when the relative humidity in the developer container is a second value higher than a first value is lower than the second rotation speed when the relative humidity in the developer container is the first value.

8. An image forming apparatus according to claim 1, further comprising an obtaining portion configured to obtain information on a toner amount consumed in association with an image forming operation, wherein the controller determines the deceleration amount per unit time of the developing rotary member in the first period based on the information on the toner amount consumed in association with the image forming operation obtained by the obtaining portion, and wherein the deceleration amount per unit time of the developing rotary member in the first period when the toner amount consumed in association with the image forming operation is a second amount larger than a first amount is lower than the deceleration amount per unit time of the developing rotary member in the first period when the toner amount consumed in association with the image forming operation is the first amount.

9. An image forming apparatus according to claim 8, wherein the controller determines the second rotation speed based on the information on the toner amount consumed in association with the image forming operation obtained by the obtaining portion, and wherein the second rotation speed when the toner amount consumed in association with the image forming operation is the second amount is lower than the second rotation speed when the toner amount consumed in association with the image forming operation is the first amount.

10. An image forming apparatus according to claim 1, further comprising an obtaining portion configured to obtain information on a toner amount consumed in association with an image forming operation, wherein the controller determines the second rotation speed based on the information on the toner amount consumed in association with the image forming operation obtained by the obtaining portion, and wherein the second rotation speed when the toner amount consumed in association with the image forming operation is a second amount larger than a first amount is lower than the second rotation speed when the toner amount consumed in association with the image forming operation is the first amount.

11. An image forming apparatus, comprising:

an image bearing member;

a developer container containing a developer including toner and carrier;

a developing rotary member configured to carry and feed the developer toward a position to develop an electrostatic latent image formed on the image bearing member;

a driving unit configured to rotate the developing rotary member; and a controller configured to control the driving unit, wherein the controller is configured to perform a mode of:

rotating the developing rotary member by the driving unit so that a rotation speed of the developing rotary member becomes a first rotation speed in an image forming period during which an image forming operation is performed, rotating the developing rotary member by the driving unit to decelerate the rotation speed of the developing rotary member from the first rotation speed in a first period of a non-image forming period during which no image forming operation is performed so that the rotation speed of the developing rotary member becomes a second rotation speed lower than the first rotation speed, and rotating the developing rotary member by the driving unit to decelerate the rotation speed of the developing rotary member from the second rotation speed in a second period subsequent to the first period of the non-image forming period so that the rotation of the developing rotary member becomes a third rotation speed lower than the second rotation speed, and wherein a deceleration amount per unit time of the developing rotary member in the first period is smaller than a deceleration amount per unit time of the developing rotary member in the second period.

12. An image forming apparatus according to claim 11, further comprising an obtaining portion configured to obtain information on a toner density as a ratio of the toner and the carrier of the developer contained in the developer container, wherein the controller determines the deceleration amount per unit time of the developing rotary member in the first period based on the information on the toner density of the developer contained in the developer container obtained by the obtaining portion, and wherein the deceleration amount per unit time of the developing rotary member in the first period when the toner density of the developer contained in the developer container is a second value higher than a first value is lower than the deceleration amount per unit time of the developing rotary member in the first period when the toner density of the developer contained in the developer container is the first value.

13. An image forming apparatus according to claim 12, wherein the controller determines the second rotation speed based on the information on the toner density of the developer contained in the developer container, and wherein the second rotation speed when the toner density of the developer contained in the developer container is the second value is lower than the second rotation speed when the toner density of the developer contained in the developer container is the first value.

14. An image forming apparatus according to claim 11, further comprising an obtaining portion configured to obtain information on a toner density as a ratio of the toner and the carrier of the developer contained in the developer container, wherein the controller determines the second rotation speed based on the information on the toner density of the developer contained in the developer container obtained by the obtaining portion, and wherein the second rotation speed when the toner density of the developer contained in the developer container is a second value higher than a first value is lower than the second rotation speed when the toner density of the developer contained in the developer container is the first value.

15. An image forming apparatus according to claim 11, further comprising an obtaining portion configured to obtain information on a relative humidity in the developer container, wherein the controller determines the deceleration amount per unit time of the developing rotary member in the first period based on the information on the relative humidity in the developer container obtained by the obtaining portion, and wherein the deceleration amount per unit time of the developing rotary member in the first period when the relative humidity in the developer container is a second value higher than a first value is lower than the deceleration amount per unit time of the developing rotary member in the first period when the relative humidity in the developer container is the first value.

16. An image forming apparatus according to claim 15, wherein the controller determines the second rotation speed based on the information on the relative humidity in the developer container obtained by the obtaining portion, and wherein the second rotation speed when the relative humidity in the developer container is the second value is lower than the second rotation speed when the relative humidity in the developer container is the first value.

17. An image forming apparatus according to claim 11, further comprising an obtaining portion configured to obtain information on a relative humidity in the developer container, wherein the controller determines the second rotation speed based on the information on the relative humidity in the developer container obtained by the obtaining portion, and wherein the second rotation speed when the relative humidity in the developer container is a second value higher than a first value is lower than the second rotation speed when the relative humidity in the developer container is the first value.

18. An image forming apparatus according to claim 11, further comprising an obtaining portion configured to obtain information on a toner amount consumed in association with an image forming operation, wherein the controller determines the deceleration amount per unit time of the developing rotary member in the first period based on the information on the toner amount consumed in association with the image forming operation obtained by the obtaining portion, and wherein the deceleration amount per unit time of the developing rotary member in the first period when the toner amount consumed in association with the image forming operation is a second amount larger than a first amount is lower than the deceleration amount per unit time of the developing rotary member in the first period when the toner amount consumed in association with the image forming operation is the first amount.

19. An image forming apparatus according to claim 18, wherein the controller determines the second rotation speed based on the information on the toner amount consumed in association with the image forming operation obtained by the obtaining portion, and wherein the second rotation speed when the toner amount consumed in association with the image forming operation is the second amount is lower than the second rotation speed when the toner amount consumed in association with the image forming operation is the first amount.

20. An image forming apparatus according to claim 11, further comprising an obtaining portion configured to obtain information on a toner amount consumed in association with an image forming operation, wherein the controller determines the second rotation speed based on the information on the toner amount consumed in association with the image forming operation obtained by the obtaining portion, and wherein the second rotation speed when the toner amount consumed in association with the image forming operation is a second amount larger than a first amount is lower than the second rotation speed when the toner amount consumed in association with the image forming operation is the first amount.

* * * * *